US008944030B2

(12) United States Patent
Suda et al.

(10) Patent No.: US 8,944,030 B2
(45) Date of Patent: Feb. 3, 2015

(54) FUEL SUPPLY APPARATUS

(75) Inventors: Toru Suda, Toyota (JP); Koji Yoshida, Kasugai (JP); Katsunori Kamiya, Kariya (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 269 days.

(21) Appl. No.: 13/393,377

(22) PCT Filed: Aug. 1, 2011

(86) PCT No.: PCT/JP2011/004362

§ 371 (c)(1),
(2), (4) Date: Feb. 29, 2012

(87) PCT Pub. No.: WO2013/018131

PCT Pub. Date: Feb. 7, 2013

(65) Prior Publication Data

US 2013/0032126 A1 Feb. 7, 2013

(51) Int. Cl.

| | |
|---|---|
| ***F02M 59/36*** | (2006.01) |
| ***F02D 41/38*** | (2006.01) |
| ***F02M 37/00*** | (2006.01) |
| ***F02D 33/00*** | (2006.01) |

(52) U.S. Cl.

CPC ..... *F02D 41/3854* (2013.01); *F02M 37/0029* (2013.01); *F02M 37/0058* (2013.01); *F02D 33/003* (2013.01)

USPC ..... 123/458; 123/457; 123/511; 123/514

(58) Field of Classification Search

USPC ..... 123/457–459, 462, 509, 511, 512, 514; 137/85, 86

See application file for complete search history.

(56) References Cited

U.S. PATENT DOCUMENTS

| | | | | |
|---|---|---|---|---|
| 5,967,119 | A | 10/1999 | Burkhard et al. | |
| 5,996,557 | A * | 12/1999 | Muraki | 123/502 |
| 6,092,509 | A * | 7/2000 | Tanabe et al. | 123/447 |
| 6,672,279 | B2 * | 1/2004 | Nakayama et al. | 123/299 |
| 6,792,919 | B2 * | 9/2004 | Kohketsu et al. | 123/447 |
| 7,171,952 | B2 * | 2/2007 | Joos et al. | 123/457 |
| 7,740,006 | B2 * | 6/2010 | Ikeya | 123/506 |
| 8,567,373 | B2 * | 10/2013 | Suda | 123/457 |
| 2002/0000219 | A1 * | 1/2002 | Augustin et al. | 123/502 |

(Continued)

FOREIGN PATENT DOCUMENTS

| | | | |
|---|---|---|---|
| EP | 837239 | A2 | 4/1998 |
| JP | 2003-148214 | A | 5/2003 |

(Continued)

*Primary Examiner* — Stephen K Cronin
*Assistant Examiner* — Joseph Dallo
(74) *Attorney, Agent, or Firm* — Sughrue Mion, PLLC

(57) ABSTRACT

The fuel supply apparatus optimizes the timing of performing the fuel pressure change indication and the fuel injection timing to suppress the real fuel injection amount from being differentiated from the target fuel injection amount even at the time of the fuel pressure being changed, thereby improving fuel consumption. The ECU judges that the fuel pressure change request is generated ("YES" in Step S11), and calculates the change retarding time t1 (Step S12) when the fuel pressure is at the low pressure side, and the ECU determines that the vehicle is in the warming-up state, or that the fuel is at the high temperature. The ECU sets the change timing to avoid the timing of injecting the fuel from overlapping the changing timing of the fuel pressure with reference to the injection timing of the fuel injection control (Step S13).

11 Claims, 17 Drawing Sheets

(56) References Cited

U.S. PATENT DOCUMENTS

| | | | | |
|---|---|---|---|---|
| 2003/0150426 | A1* | 8/2003 | Tanabe et al. | 123/457 |
| 2004/0000289 | A1* | 1/2004 | Seo et al. | 123/447 |
| 2005/0126534 | A1 | 6/2005 | Kikutani | |
| 2005/0229896 | A1* | 10/2005 | Hori | 123/198 D |
| 2007/0186908 | A1* | 8/2007 | Fukasawa | 123/458 |
| 2009/0151703 | A1 | 6/2009 | Ikeya | |
| 2010/0175666 | A1 | 7/2010 | Nishio et al. | |
| 2010/0242920 | A1 | 9/2010 | Omori et al. | |
| 2012/0312395 | A1* | 12/2012 | Suzuki et al. | 137/505 |

FOREIGN PATENT DOCUMENTS

| | | | |
|---|---|---|---|
| JP | 2005-171928 | A | 6/2005 |
| JP | 2009-144686 | A | 7/2009 |
| JP | 2009-250211 | A | 10/2009 |
| JP | 2010-156228 | A | 7/2010 |
| JP | 2010-185449 | A | 8/2010 |
| JP | 2010-229877 | A | 10/2010 |
| WO | WO 2011/001478 | A1 | 1/2011 |
| WO | WO 2011/099055 | A1 | 8/2011 |

* cited by examiner

FUEL SUPPLY APPARATUS

CROSS REFERENCE TO RELATED APPLICATIONS

This application is a National Stage of International Application No. PCT/JP2011/004362 filed Aug. 1, 2011 the contents of all which are incorporated herein by reference in their entirety.

TECHNICAL FIELD

The present invention relates to a fuel supply apparatus for supplying fuel reserved in a fuel tank to a fuel consumption unit after adjusting the supply pressure of the fuel.

BACKGROUND ART

Up until now, the fuel supply apparatus of this type for the internal combustion engine to be mounted on an automotive vehicle, comprises a fuel tank for reserving the fuel, a fuel pump for pumping the fuel from the fuel tank to supply the fuel to a fuel consumption unit, and a pressure controlling apparatus for adjusting the fuel supply pressure when the fuel is supplied to the fuel consumption unit by the fuel pump. The pressure controlling apparatus is adapted to adjust the fuel supply pressure to injectors forming part of the fuel consumption unit with the fuel pump for pumping up the fuel from the fuel tank.

The pressure controlling apparatus of this kind is generally provided with a housing, and a diaphragm having an adjustment valve at the central portion thereof and separating the housing into two chambers. The diaphragm has one surface side receiving the fuel pressure in one of the adjustment chambers to have the central portion deformed in the directions to close or open the adjustment valve in response to the fuel pressure varied, and the other surface side held in engagement with a compression coil spring to have the diaphragm suppressed from being deformed. The pressure controlling apparatus thus constructed is adapted to have the pressure adjustment valve held in the open state until the fuel pressure in the pressure adjustment chamber reaches the set pressure. Further, the pressure control apparatus is usually disposed in the fuel tank together with the fuel pump.

As a pressure controlling apparatus, there has so far been proposed a pressure controlling apparatus provided with a variable fuel pressure adjustment valve which comprises a diaphragm for dividing the inside of a housing into an adjustment chamber and a back pressure chamber, the adjustment chamber facing one surface side and having a fuel introduction port through which the pressurized fuel is introduced from the fuel pump, the back pressure chamber facing the other surface side and having a fuel discharge port through which the back pressure fluid is introduced, a plunger forming an open chamber open to the atmosphere between the diaphragm and the back pressure chamber, a valve member provided on the diaphragm to selectively open or close the discharge port in response to the deformation of the diaphragm, a spring intervening between the diaphragm and the plunger to urge the valve member in the direction to open or close the valve member, and a stop member for regulating the movement range of the plunger (for example see Patent Document 1).

The fuel supply apparatus disclosed in the Patent Document 1 is provided with the variable fuel pressure adjustment valve forming part of the pressure controlling apparatus thus constructed, so that supplying or not supplying the back pressure fluid causes the set load of the spring to be changed at two stages, thereby making it possible to change the set value of the fuel pressure to be adjusted into any one of the low side or the high side.

However, the fuel supply apparatus disclosed in the Patent Document 1 encounters such a problem that it is difficult to make the fuel supply apparatus small in size since the variable fuel pressure adjustment valve is required to have three chambers formed therein although the fuel pressure can be changed by only one variable fuel pressure adjustment valve. The known supply apparatus encounters another problem that the variable fuel pressure adjustment valve is required to be disposed within several limitations, resulting from the fact that the pipes for supplying the fuel to the pressure adjustment chamber and the back pressure chamber are forced to be connected in opposite directions with each other.

In addition, the control unit for controlling the fuel pressure is not designed in consideration of the time necessary for changing the fuel pressure. For this reason, there may cause some cases in which the fuel is injected during the fuel pressure change, and in which the target fuel pressure is differentiated from the real fuel pressure. As a result, the injection amount to each of the cylinders is not adequate, thereby causing another problem encountered by the conventional fuel supply apparatus that there is a possibility that the air-fuel ratio differs from the target air-fuel ratio.

In view of these problems, it is known as the fuel supply apparatus capable of changing the fuel pressure that the changing time for the fuel pressure is estimated (for example see Patent Document 2).

The fuel supply apparatus disclosed in the Patent Document 2 comprises two variable fuel pressure adjustment valves, electromagnet valves for changing the states of the variable fuel pressure adjustment valves, and an ECU for controlling the electromagnet valves. The fuel supply apparatus disclosed in the Patent Document 2 is different from the fuel supply apparatus disclosed in the Patent Document 1, but requires two variable fuel pressure adjustment valves for changing the fuel pressure, thereby making it impossible to solve the problem to downsize the fuel supply apparatus. However, the fuel supply apparatus disclosed in the Patent Document 1 can make the real air-fuel ratio near the target air-fuel ratio by having the ECU set the fuel injection amount to the cylinder in response to the fuel pressure. For changing the fuel pressure, the fuel supply apparatus is adapted to predict the change of the real fuel pressure based on the rotation number of the engine.

CITATION LIST

Patent Literature

{PLT 1} Patent Publication No. JP 2009-144686
{PLT 2} Patent Publication No. JP 2009-250211

SUMMARY OF INVENTION

Technical Problem

However, the fuel supply apparatus disclosed in the Patent Document 2 previously mentioned is not designed in consideration of the response times of the electromagnet valves themself necessary for changing the two variable fuel pressure adjustment valves although the fuel supply apparatus is adapted to predict the variation of the real fuel pressure in response to the engine rotation number when the fuel pressure is changed.

For this reason, the response times of the electromagnet valves themself tend to be varied in response to the travel states of the vehicle, and the time interval is apt to be varied from the time when the ECU is operated to indicate the change of the fuel pressure to the time when the fuel pressure really starts to be varied. Moreover, it takes more time to have the variation of the fuel pressure converged. In spite of these facts, the ECU has not been sufficiently optimized in term of the timing of conducting the fuel pressure change indication and the timing of injecting the fuel. This leads to the fact that the fuel is completely injected in the state that the real fuel pressure is not matched with the target fuel pressure, thereby resulting in a possibility that the real fuel injection amount comes to be different from the desired fuel injection amount. For this reason, there is caused a problem that the degree of accuracy of the fuel injection control is lowered, thereby making it impossible to enhance the fuel consumption.

The present invention has been made for solving these problems, and thus has an object to provide a fuel supply apparatus having a variable fuel pressure adjustment valve which not only can sufficiently optimize the timing of conducting the fuel pressure change indication and the timing of injecting the fuel but also can suppress the real fuel injection amount from being differentiated from the desired fuel injection amount.

Solution to Problem

For overcoming the previously mentioned object, the fuel supply apparatus according to the present invention for supplying fuel to a fuel consumption unit after adjusting the pressure of the fuel comprises: a variable fuel pressure adjustment valve capable of assuming at least one of a high pressure state in which the fuel is maintained at a high pressure, and a low pressure state in which the fuel is maintained at a low pressure, a changeover valve for changing the variable fuel pressure adjustment valve between the high pressure state and the low pressure state in response to an electric property of an electric power inputted therein, and a switching control unit for controlling the electric power to be inputted or not inputted into the changeover valve, the switching control unit being operative to set the switching timing of switching the changeover valve selectively in the high pressure state or in the low pressure state in accordance with the electric property of the electric power inputted into the changeover valve.

By the above construction of the fuel supply apparatus, the switching control unit can change the control timing to the changeover valve in response to the electric property inputted into the changeover valve. This means that even in the case of the states of the changeover valve being different in change time in response to the electric property, the change timing can be varied, thereby making it possible to reduce the effect imparted to the fuel injection control to a level as low as possible. This leads to the fact that the fuel supply apparatus thus constructed can sufficiently optimize the timing of conducting the fuel pressure change indication and the timing of injecting the fuel, which results in suppressing the real fuel injection amount from being differentiated from the desired fuel injection amount even when the fuel pressure is changed. Further, the fuel supply apparatus can enhance the degree of accuracy of the fuel injection control and can accomplish the improvement of the fuel consumption.

Further, in the fuel supply apparatus as set forth in the above, the switching control unit is set to make early the switching timing of the changeover valve when the changeover valve has an early switch starting value as compared with when the changeover valve has a delay switch starting value.

By the above construction of the fuel supply apparatus, the switching control unit is operated to make early the switching timing of the changeover valve when the electric property has a value to allow the changeover valve to start switching late to the changeover valve as compared with when the electric property has a value to allow the changeover valve to start switching early to the changeover valve, so that the change timing can be made earlier, thereby making it possible to reduce the effect of electric property imparted to the fuel injection control to a level as low as possible.

Further, in the fuel supply apparatus as set forth in the above, the electric property has a value indicative of the magnitude of an electromotive force of an alternator operative to generate the electric power with the drive force outputted from an internal combustion engine.

By the above construction of the fuel supply apparatus, the switching control unit can calculate the timing of changing the states of the changeover valve in accordance with the magnitude of the electromotive force of the alternator. This makes it unnecessary to directly detect the fuel pressure of the fuel to be supplied to the fuel consumption unit, thereby making it unnecessary to provide a sensor for detecting the fuel pressure. Therefore, the fuel supply apparatus can enhance the degree of accuracy of the fuel pressure change control even if the fuel supply apparatus can be produced at a low cost.

Further, in the fuel supply apparatus as set forth in the above, the switching control unit is operative to have the electromotive force of the alternator as the electric property before the state of the changeover valve is changed.

By the above construction of the fuel supply apparatus, the switching control unit can set the timing of starting to change the states of the changeover valve based on the electromotive force of the alternator. This makes it possible to estimate the time of reaching the steady pressure state of the fuel pressure, in the case that the times required to change the states of the changeover valve and the time interval from the time when the fuel pressure is changed to the time when the fuel pressure is returned to the steady pressure state are preliminarily measured.

Further, the fuel supply apparatus according to the present invention for supplying fuel to a fuel consumption unit after adjusting the pressure of the fuel comprises: a variable fuel pressure adjustment valve capable of assuming at least one of a high pressure state in which the fuel is maintained at a high pressure, and at a low pressure state in which the fuel is maintained at a low pressure, a changeover valve for changing the variable fuel pressure adjustment valve between the high pressure state and the low pressure state in response to an electric property of an electric power to be inputted therein, and a switching control unit for controlling the electric power to be inputted or not inputted into the changeover valve, the switching control unit being operative to detect the electric property of the electric power to be inputted or not inputted into the changeover valve under the condition that the supply or the non-supply of the electric power to the changeover valve is changed, and to estimate the time required to change the fuel pressure in accordance with the detected electric property.

By the above construction of the fuel supply apparatus, the switching control unit can calculate the timing of changing the states of the changeover valve in accordance with electric property inputted into the changeover valve. This means that even in the case of the states of the changeover valve being different in change time in response to the electric property, the change time of changing the states of the changeover valve can be calculated, thereby making it possible to reduce the effect imparted to the fuel injection control at a level as low as possible. This leads to the fact that the fuel supply apparatus thus constructed can sufficiently optimize the timing of conducting the fuel pressure change indication and the timing of injecting the fuel, which result in suppressing the real fuel injection amount from being differentiated from the desired fuel injection amount even when the fuel pressure is changed. Further, the fuel supply apparatus can enhance the degree of accuracy of the fuel injection control and can accomplish the improvement of the fuel consumption.

Further, in the fuel supply apparatus as set forth in the above, the switching control unit is operative to estimate the time required to change the fuel pressure after the supply or the non-supply of the electric power to the changeover valve is changed and before the state of the changeover valve starts to be changed.

By the above construction of the fuel supply apparatus, the switching control unit can estimate the time of starting to change the states of the changeover valve. This leads to the fact that the fuel supply apparatus thus constructed can sufficiently optimize the timing of conducting the fuel pressure change indication and the timing of injecting the fuel, which result in suppressing the real fuel injection amount from being differentiated from the desired fuel injection amount even when the fuel pressure is changed.

Further, in the fuel supply apparatus as set forth in the above, the switching control unit is operative to have as the electric property an electric current value inputted into the changeover valve.

By the above construction of the fuel supply apparatus, the switching control unit can calculate the time required to change the states of the changeover valve even after the indication to change the changeover valve is performed.

Further, the fuel supply apparatus as set forth in the above, further comprises a fuel injection control unit for controlling the timing of injecting the fuel in the fuel consumption unit, the fuel injection control unit being operative to adjust the timing of injecting the fuel based on the time required to change the fuel pressure and calculated by the switching control unit.

By the above construction of the fuel supply apparatus, the switching control unit can calculate the time required to change the fuel pressure even after the change of the fuel pressure is generated, so that the fuel pressure at a certain time can be estimated, and the fuel injection can be executed in accordance with the estimated fuel pressure at the certain time, thereby making it possible to enhance the degree of accuracy of the fuel injection amount.

Further, the fuel supply apparatus as set forth in the above, further comprises a wire breaking detection unit for detecting whether or not there is generated the breaking of an electric wire to supply the electric current to the changeover valve based on the magnitude of the electric current flowing in the electric wire, the switching control unit being operative to calculate the switching timing based on the magnitude of the electric current detected by the wire breaking detection unit.

By the above construction of the fuel supply apparatus, the switching control unit can calculate the timing of changing the states of the changeover valve in accordance with the magnitude of the electric current to be supplied to the changeover valve. This makes it unnecessary to directly detect the fuel pressure of the fuel to be supplied to the fuel consumption unit, thereby making it unnecessary to provide a sensor for detecting the fuel pressure. Therefore, the fuel supply apparatus can enhance the degree of accuracy of the fuel pressure change control even if the fuel supply apparatus can be produced at a low cost.

Further, in the fuel supply apparatus as set forth in the above, the variable fuel pressure adjustment valve comprises a housing having a fuel introduction opening through which the fuel is introduced into the housing and a fuel discharge opening through which the fuel is discharged to the outside, and a pressure adjustment member having a partition wall portion forming together with the housing a pressure adjustment chamber held in communication with the fuel introduction opening, and a movable valve portion displaceable in response to the fuel pressure in the pressure adjustment chamber in a direction to take its opening state in which the pressure adjustment chamber is brought into communication with the fuel discharge opening, the housing accommodating therein a first valve seat portion and a second valve portion, the first valve seat portion forming in the inside of the pressure adjustment chamber a discharge passage to be held in communication with the fuel discharge opening and variable in opening degree in response to the movable valve portion, and the second valve portion forming in the inside of the pressure adjustment chamber an operation pressure fuel introduction passage to be variable in opening degree in response to the movable valve portion and to allow the fuel having an operation pressure to be introduced therein, the pressure adjustment member having an area to receive the fuel pressure in the direction to take its opening state, the area being variable in response to the operation pressure in the operation pressure fuel introduction passage.

By the above construction of the fuel supply apparatus, the pressure adjustment member has a fuel pressure receiving area variable to enable the fuel pressure to be adjusted at two stages. This makes it unnecessary to divide the inside of the variable fuel pressure adjustment valve into three chambers, or otherwise to provide two variable fuel pressure adjustment valves in the fuel supply apparatus, but makes it possible to control the fuel pressure to be supplied to the fuel consumption unit at two stages. For this reason, it is possible to downsize the fuel supply apparatus.

Advantageous Effects of Invention

The present invention can provide a fuel supply apparatus having a variable fuel pressure adjustment valve which not only can sufficiently optimize the timing of conducting the fuel pressure change indication and the timing of injecting the fuel but also can suppress the real fuel injection amount from being differentiated from the desired fuel injection amount, thereby making it possible to accomplish the improvement of the fuel consumption.

DESCRIPTION OF EMBODIMENTS (First Embodiment)

The first embodiment of the present invention will be described hereinafter with reference to the accompanying drawings. The present embodiment will be explained hereinafter with reference to the case in which the fuel supply apparatus is applied to an automotive vehicle having an engine with four gasoline cylinders mounted thereon.

The construction of the present embodiment will firstly be described.

Figure 1:
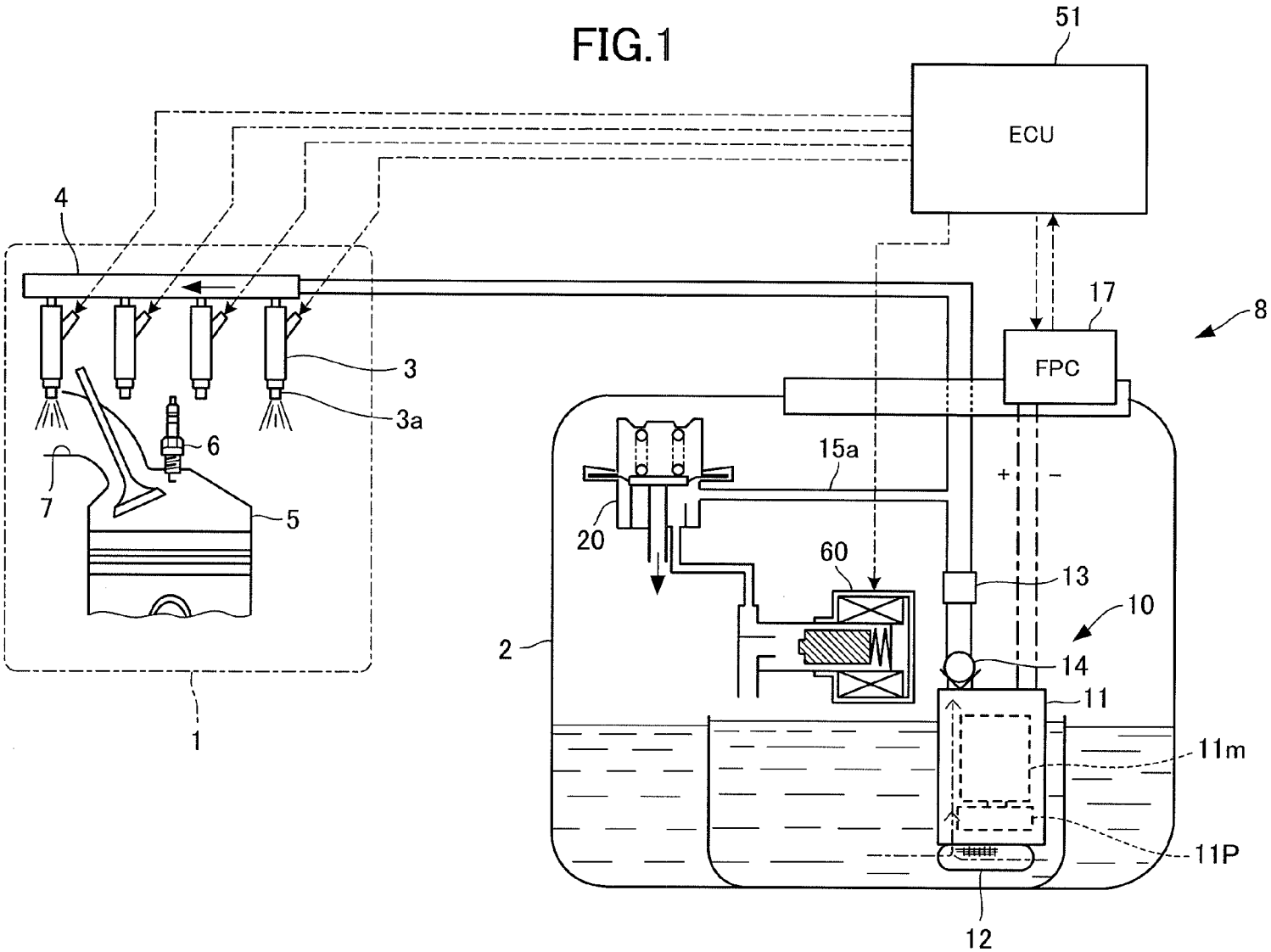
FIG. 1 is a schematic construction view of a fuel supply apparatus and its peripheral portion thereof according to the first embodiment of the present invention.

As shown in FIG. 1, the fuel supply apparatus 8 according to the first embodiment of the present invention comprises a fuel tank 2 for storing fuel to be consumed by an engine 1, a fuel supply mechanism 10 for supplying the fuel stored in the fuel tank 2 to a plurality of injectors 3 forming part of the engine 1, a pressure regulator 20 for introducing the fuel to be supplied to injectors 3 from the fuel supply mechanism 10 to adjust the pressure of the fuel to a predetermined fuel pressure P1, a changeover valve 60 for controlling the pressure regulator 20 to change the fuel pressure P1 to be adjusted by the pressure regulator 20 between a high pressure state and a low pressure state. Here, the pressure regulator 20 constitutes a variable fuel pressure adjustment valve according to the present invention.

The engine 1 is constituted by an internal combustion engine having a multiplicity of cylinders to be mounted on the automotive vehicle. The internal combustion engine raised in the present embodiment is constituted by a 4-cycle gasoline engine provided with four cylinders 5. Here, each of the cylinders 5 constitutes a fuel consumption portion according to the present invention. The injectors 3 are provided on the cylinders 5, respectively, of the engine 1, and each of the injectors 3 has an end portion 3*a* formed with an injection nozzle and exposed in a suction port 7 formed in each of the cylinders 5.

The fuel supply mechanism 10 is connected with the injectors 3 through delivery pipes 4 so that the fuel from the fuel supply mechanism 10 is distributed to the injectors 3 through the delivery pipes 4.

The fuel supply mechanism 10 comprises a fuel pump unit 11, a suction filter 12, a fuel filter 13, and a check valve 14. The fuel pump unit 11 is adapted to suck the fuel in the fuel tank 2 through a suction port and to pressurize and discharge the fuel through a discharge port. The suction filter 12 is provided on the suction side of the fuel pump unit 11 and designed to check foreign objects from being sucked into the fuel pump unit 11. The fuel filter 13 is provided on the discharge side of the fuel pump unit 11 and functions to remove the foreign objects included in the fuel discharged from the fuel pump unit 11. The check valve 14 is provided on either the upstream side or the downstream side of the fuel filter 13.

The fuel pump unit 11 comprises a fuel pump 11*p* having a plurality of impellers for performing an pumping action, and a pump drive motor 11*m* constituted by a direct-current motor accommodated therein to drive the fuel pump 11*p*. The fuel pump unit 11 is constructed to be controlled by an ECU (Electronic Control Unit) 51 to have the pump drive motor 11*m* selectively energized or deenergized to be driven or stopped.

The fuel pump unit 11 is capable of varying the discharge amount and the discharge pressure of the fuel per unit time by pumping up and pressurizing the fuel in the fuel tank 2, varying the rotation speed (rpm) of the pump drive motor 11*m* in response to the load torque for the same supply electric voltage, and varying the rotation speed (rpm) of the pump drive motor 11*m* in response to the change of the supply electric voltage.

The check valve 14 is operative to be opened to have the fuel supplied to the injectors 3 from the fuel pump unit 11, while closed to have the fuel checked from being returned to the fuel pump unit 11 from the injectors 3.

On the upper portion of the fuel pump 2 is provide a fuel pump controller 17 (hereinafter simply referred to as "FPC") for controlling the operation of the fuel pump unit 11. The FPC 17 has mounted thereon an electric-voltage detection unit for detecting the terminal electric voltage of the pump drive motor 11*m*, and an electric current detection unit for detecting the electric current flowing in the pump drive motor 11*m*.

The FPC 17 is adapted to control the electric voltage to be applied to the pump drive motor 11*m* of the fuel pump unit 11 in response to the difference between the pump control signal from the ECU 51 and the detection signal of the electric voltage detection unit for detecting the terminal electric voltage of the pump drive motor 11*m*, and to supply the ECU 51 with a diagnosis signal in response to the operation state of the pump drive motor 11*m* for conducting the abnormal diagnosis of the fuel supply mechanism 10.

Figure 3:
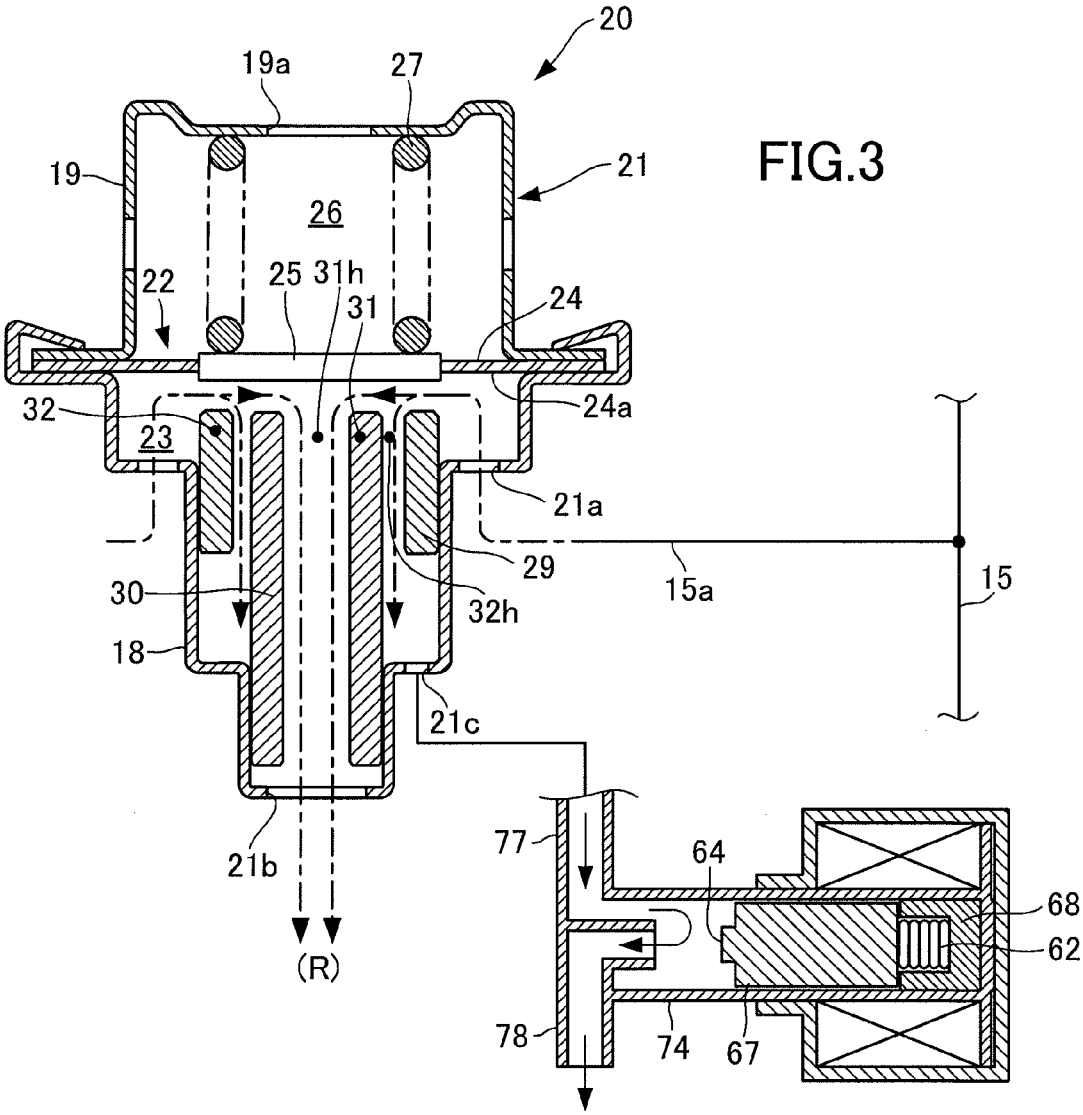
FIG. 3 is a schematic construction view, shown in cross-section, of the fuel supply apparatus according to the first embodiment of the present invention, the fuel supply apparatus being maintained in the high pressure supply state.

As shown in FIGS. 1 and 3, the pressure regulator 20 is provided with a housing 21 having a fluid introduction opening 21*a* through which the fuel is introduced in the housing 21, and a fluid discharge opening 21*b* through which the fuel is discharged from the housing 21 to the outside. The housing 21 has a pair of housing members 18, 19 in the form of a cavity shape and having respective outer peripheral portions deformed and coupled with each other by a caulking tool.

In the housing 21 is provided a pressure adjustment member 22 in the form of a partition wall to separate the inner space of the housing 21 into two chambers. The pressure adjustment member 22 comprises a partition wall portion 24 and a movable valve body portion 25. The partition wall portion 24 forms together with the housing 21 a pressure adjustment chamber 23 which is held in communication with the fluid introduction opening 21*a*. The movable valve body portion 25 is movable with respect to the housing 21 toward and away from the fluid discharge opening 21*b* to selectively close or open the passage from the fluid introduction opening 21*a* to the fluid discharge opening 21*b*, and capable of having the pressure adjustment chamber 23 held into communication with the fluid discharge opening 21*b* at an opening degree variable in response to the fuel pressure in the pressure adjustment chamber 23. The partition wall portion 24 and the movable valve body portion 25 are integrally formed with each other. The partition wall portion 24 has one surface to always receive the fuel pressure in the pressure adjustment chamber 23.

The partition wall portion 24 has the other surface forming together with the housing 21 a back pressure chamber 26 accommodating therein the fuel which imparts the back pressure to the pressure adjustment chamber 23. In the back pressure chamber 26 is provided a compression coil spring 27 which resiliently urges the movable valve body portion 25 of the pressure adjustment member 22 in a direction to close the passage from the fluid introduction opening 21*a* to the fluid discharge opening 21*b*. The back pressure chamber 26 is formed by the pressure adjustment member 22 and the housing member 19, the latter of which is formed with at least one atmospheric pressure introduction opening 19*a*.

Figure 2:
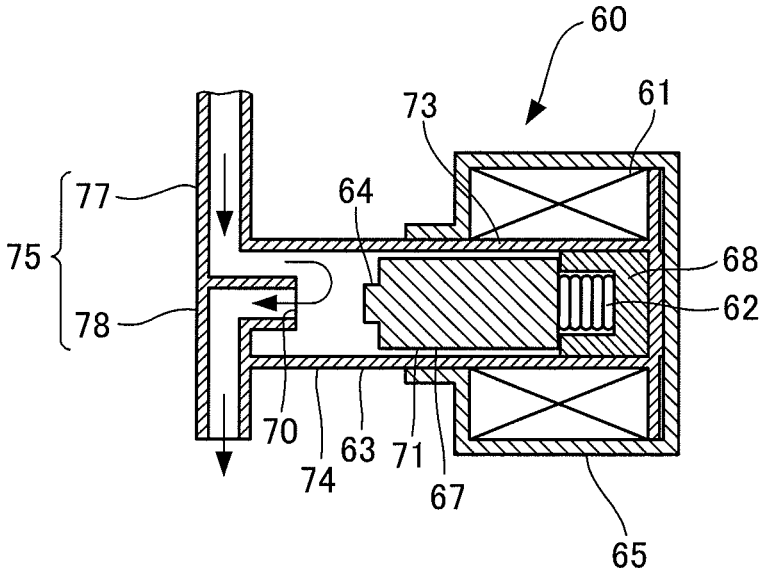
FIG. 2 is a schematic construction view of a changeover valve forming part of the fuel supply apparatus according to the first embodiment of the present invention.

In the housing 21 are provided an outer cylindrical member 29 and an inner cylindrical member 30 different in diameter from each other. The outer cylindrical member 29 and the inner cylindrical member 30 have respective end portions facing the movable valve body portion 25 and formed with a first valve seat portion 31 and a second valve seat portion 32, respectively. The outer cylindrical member 29 and the inner cylindrical member 30 form therebetween an operation pressure fuel introduction As shown in FIG. 2, the changeover valve 60 is adapted to change the fuel pressure in the operation pressure fuel introduction passage 32*h* of the pressure regulator 20, and comprises a bobbin 63 made of a synthetic resin, an electromagnet coil 61, a valve 67, a compression coil spring 62, a shield member 65 covering the outer peripheral portion of the electromagnet coil 61, and a stator core 68.

The bobbin 63 has a bobbin portion 73, a cylinder portion 74, and a fuel pipe portion 75. The bobbin portion 73 has an outer peripheral portion on which the electromagnet coil 61 is wound, and an inner peripheral portion in which the compression coil spring 62 is accommodated.

The cylinder portion 74 and the bobbin portion 73 are formed to have respective inner surfaces held in coplanar relationship with each other, the cylinder portion 74 having a valve 67 reciprocably accommodated therein.

The fuel pipe portion 75 is fanned on the end portion of the cylinder portion 74, and has a fuel introduction pipe 77 allowing the fuel to be introduced therein through the operation pressure discharge opening 21*c* of the pressure regulator 20, a fuel discharge pipe 78 allowing the fuel to be returned to the fuel tank 2, and an opening end portion 70 having an opening formed therein to face the inner space of the cylinder portion 74.

The valve 67 is made of an electromagnet in the form of a roughly cylindrical column shape, and has an armature portion 71, and a seal portion 64 formed on the one end of the armature portion 71. The fuel pipe portion 75 and the valve 67 thus constructed leads to the fact that when the valve 67 is moved in the cylinder portion 74 to have the seal portion 64 close the opening end portion 70 with pressing force, the fluid passages in the fuel introduction pipe 77 and the fuel discharge pipe 78 are checked from being in communication with each other.

The compression coil spring 62 functions to resiliently urge the valve 67 in a direction to check the fluid passages in the fuel introduction pipe 77 and the fuel discharge pipe 78 from being in communication with each other.

The changeover valve 60 thus constructed is, as shown in FIG. 3, operative to have the valve 67 attracted against the urging force of the compression coil spring 62 under the influence of the electromagnet coil 61 when the electromagnet coil 61 is energized and thus in the "ON" state, thereby bringing the passages in the fuel introduction pipe 77 and the fuel discharge pipe 78 into communication with each other. This means that the fuel introduced into the fuel introduction pipe 77 is discharged from the fuel discharge pipe 78 through the cylinder portion 74.

Figure 4:
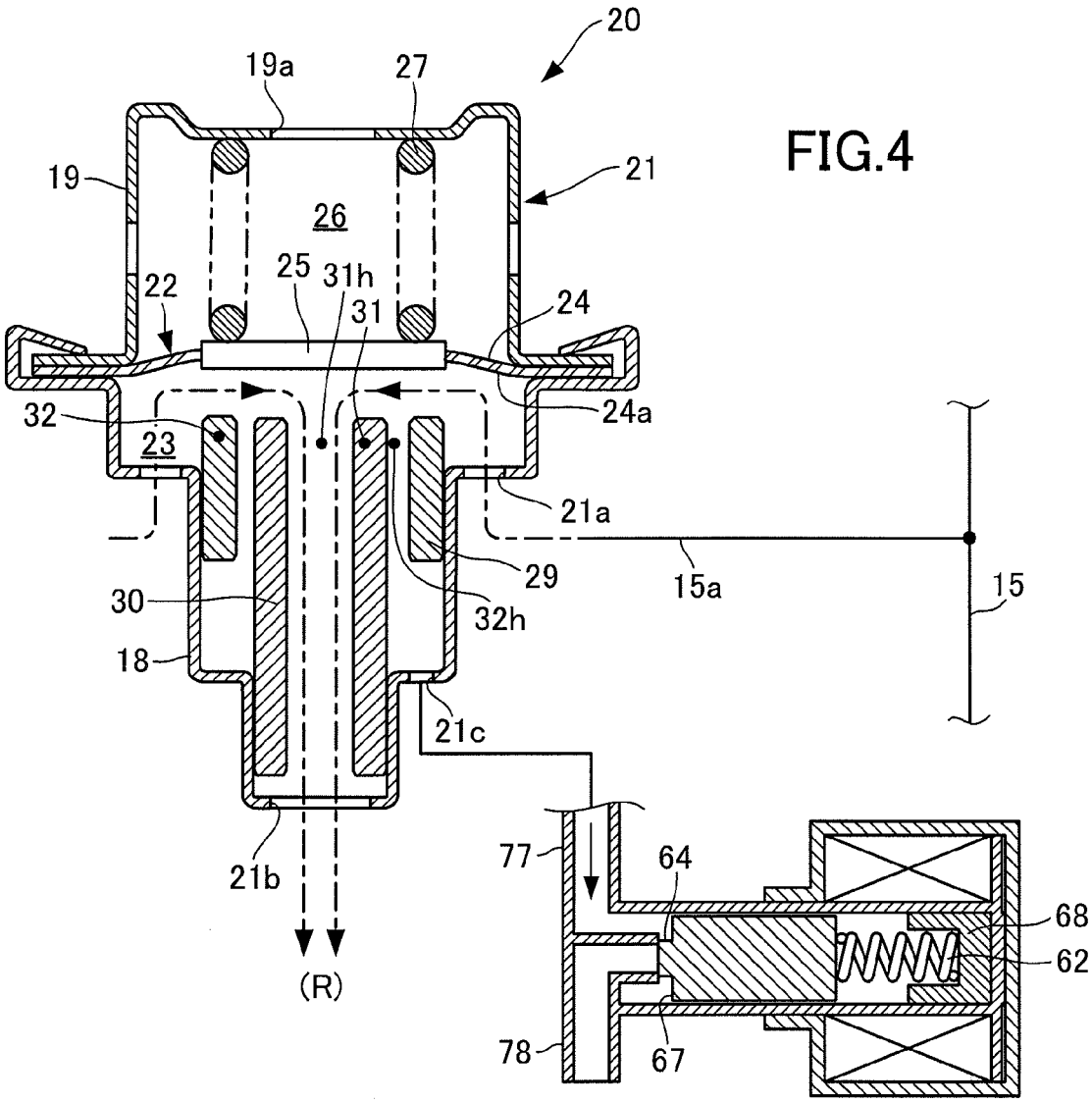
FIG. 4 is a schematic construction view, shown in cross-section, of the fuel supply apparatus according to the first embodiment of the present invention, the fuel supply apparatus being maintained in the low pressure supply state.

On the other hand, when the electromagnet coil 61 is deenergized and thus in the "OFF" state, the changeover valve 60 is, as shown in FIG. 4, operative to have the valve 67 moved to check the passages in the fuel introduction pipe 77 and the fuel discharge pipe 78 from being brought into communication with each other under the influence of the urging force of the compression coil spring 62. This means that the fuel introduced into the fuel introduction pipe 77 is checked from being discharged to the fuel tank 2.

Next, the operation of the pressure regulator 20 at the time of the fuel pressure being held in the high pressure state will be explained hereinafter.

When the fuel pressure is set at the high pressure by the ECU 51 during the operation of the fuel pump unit 11 (see FIG. 1), the changeover valve 60 is controlled by the ECU 51 to be in the "ON" state as shown in FIG. 3.

At this time, the seal portion 64 of the valve 67 is moved away from the opening end portion 70 to have the passage of the fuel introduction pipe 77 brought into communication with the passage of the fuel discharge pipe 78. This means that the operation pressure fuel introduction passage 32*h* of the pressure regulator 20 is brought into the inside of the fuel tank 2, so that the discharge passage 31*h* and the operation pressure fuel introduction passage 32*h* come to be at the atmospheric pressure. The pressure adjustment member 22 is thus urged in a direction to be opened only by the fuel in the pressure adjustment chamber 23. The effective pressure receiving area of the pressure adjustment member 22 is formed by the annular pressure receiving surface 24*a* of the partition wall portion 24. Therefore, the urging force having the movable valve body portion 25 move in a direction to take its closing state is increased, and thus the deflection amount of the compression coil spring 27 capable of urging the movable valve body portion 25 to move in the direction to take the closing state is decreased. This means that the movable valve body portion 25 is moved with respect to the first valve seat portion 31 and the second valve portion 32 in the direction to take the closing state.

The closing direction movement of the movable valve body portion 25 causes the amount of fuel to be supplied to the pressure adjustment chamber 23 through a branch passage 15*a* from the fuel passage 15 to be decreased, thereby resulting in the fact that the pressure of the fuel through the fuel passage 15 can be adjusted to the high pressure.

When, on the other hand, the fuel pressure is set at the low pressure by the ECU 51 during the operation of the fuel pump unit 11, the changeover valve 60 is controlled by the ECU 51 to be in the "OFF" state as shown in FIG. 4.

At this time, the seal portion 64 of the valve 67 is moved into engagement with the opening end portion 70 to have the passage of the fuel introduction pipe 77 brought out of communication with the passage of the fuel discharge pipe 78. This means that the fuel pressure of the operation pressure fuel introduction passage 32*h* of the pressure regulator 20 come to be equal to the fuel pressure in the pressure adjustment chamber 23 due to the closing state of the passage end downstream of the operation pressure fuel introduction passage 32*h* and the fuel introduction pipe 77. Only the discharge passage 31*h* comes to be at the atmospheric pressure. The pressures of the fuel in the pressure adjustment chamber 23 and the operation pressure fuel introduction passage 32*h* urge the pressure adjustment member 22 in the direction to take its opening state. The effective receiving pressure area of the pressure adjustment member 22 is therefore expanded and includes a pressure receiving surface roughly in the form of a circular shape in opposing relationship with the annular pressure receiving surface 24*a* of the partition wall portion 24 and the operation pressure fuel introduction passage 32*h*. Therefore, the urging force having the movable valve body portion 25 move in a direction to take its opening state is increased, and thus the deflection amount of the compression coil spring 27 to urge the movable valve body portion 25 to move in the direction to take the opening state is increased, so that the movable valve body portion 25 is moved with respect to the first valve seat portion 31 and the second valve portion 32 in the direction to take the opening state.

The opening direction movement of the movable valve body portion 25 causes the amount of fuel to be supplied to the pressure adjustment chamber 23 through a branch passage 15*a* from the fuel passage 15 to be increased, thereby resulting in the fact that the pressure of the fuel through the fuel passage 15 can be adjusted to the low pressure.

Figure 5:
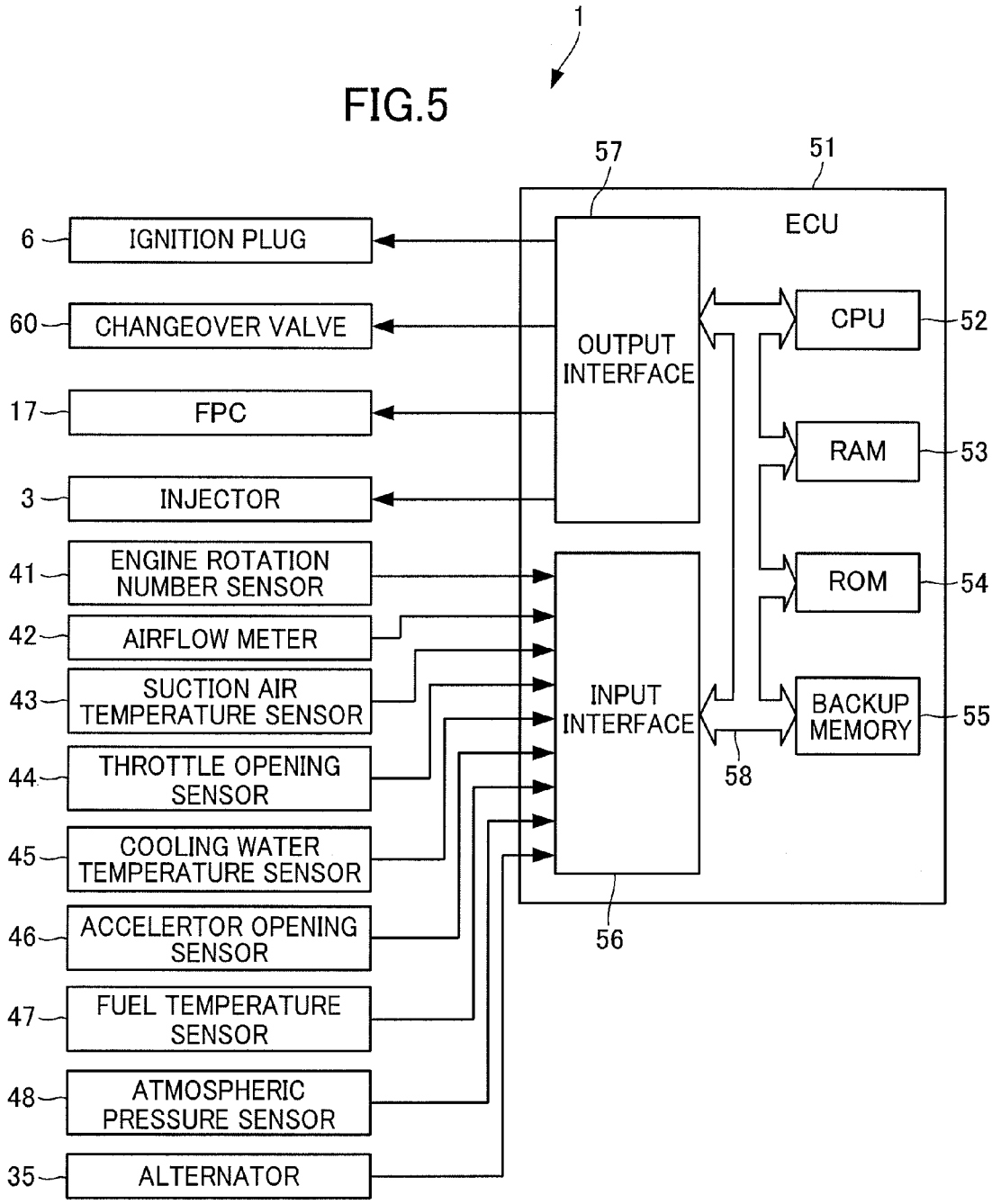
FIG. 5 is a schematic block construction view of the fuel supply apparatus according to the first embodiment of the present invention.

As shown in FIG. 5, the automotive vehicle having mounted thereon an engine 1 according to the present embodiment comprises an engine rotation number sensor 41, an air flow meter 42, a suction air temperature sensor 43, a throttle opening degree sensor 44, a cooling water temperature sensor 45, an accelerator opening degree sensor 46, a fuel temperature sensor 47, and an atmospheric pressure sensor 48. These sensors are adapted to output signals indicative of the detection results, respectively to the ECU 51.

The engine rotation number sensor 41 is adapted to detect the rotation number of a crank shaft forming part of the engine 1 and output a detection signal indicative of the engine rotation number Ne to the ECU 51. The air flow meter 42 is disposed at a position upstream of the throttle valve not shown to output a detection signal indicative of a suction amount of air to the ECU 51. The suction air temperature sensor 43 is disposed in a suction manifold not shown to output a detection signal indicative of the temperature of the suction air to the ECU 51. The throttle opening degree sensor 44 is adapted to output a detection signal indicative of the opening degree of the throttle valve to the ECU 51.

The cooling water temperature sensor 45 is disposed in a water jacket formed in a cylinder block fanning part of the engine 1 to output a detection signal indicative of the cooling water temperature Tw of the engine 1 to the ECU 51. The accelerator opening degree sensor 46 is adapted to output a detection signal indicative of the depression amount of the accelerator pedal to the ECU 51.

The fuel temperature sensor 47 is adapted to output a detection signal indicative of the temperature of the fuel flowing in the fuel passage 15 to the ECU 51. The atmospheric pressure sensor 48 is adapted to output a detection signal indicative of the atmospheric pressure.

The ECU 51 is, as shown in FIG. 5, provided with a CPU (Central Processing Unit) 52, a RAM (Random Access Memory) 53, a ROM (Read Only Memory) 54, and a backup memory 55. The ECU 51 according to the present embodiment constitutes a switching control unit and a fuel supply control unit according to the present invention.

The ROM 54 is adapted to memorize various kinds of control programs including a control program for executing the fuel pressure change control and the fuel injection control of the cylinder 5, and a map to be referred for executing the above control programs. The CPU 52 is adapted to execute various kinds of arithmetic processing based on the control programs and the map memorized in the ROM 54. The RAM 53 is adapted to temporarily memorize the results of the arithmetic processing performed by the CPU 52, and the data inputted from the various sensors previously mentioned. The backup memory 55 is constituted by an involatile memory which serves to memorize the data to be stored for example when the engine 1 is stopped.

The CPU 52, RAM 53, the ROM 54, and the backup memory 55 are connected with each other as well as connected with an input interface 56 and an output interface 57 through a bus 58.

The input interface 56 is connected with the engine rotation number sensor 41, the air flow meter 42, the suction air temperature sensor 43, the throttle opening degree sensor 44, the cooling water temperature sensor 45, the accelerator opening degree sensor 46, the fuel temperature sensor 47, and the atmospheric pressure senor 48. Further, the input interface 56 is connected with the alternator 35. According to the present invention, the vehicle may have an additional ECU mounted thereon other than the ECU 51 through which some of the sensors are operative to output their signals to the ECU 51 by way of the additional ECU.

The output interface 57 is connected with the injectors 3, the ignition plugs 6, the FPC 17, the changeover valve 60, and the throttle valves not shown. The ECU 51 is adapted to execute the various kinds of controls including the fuel pressure change control, the fuel injection control and the like based on the signals outputted by the previously mentioned sensors.

Figure 6:
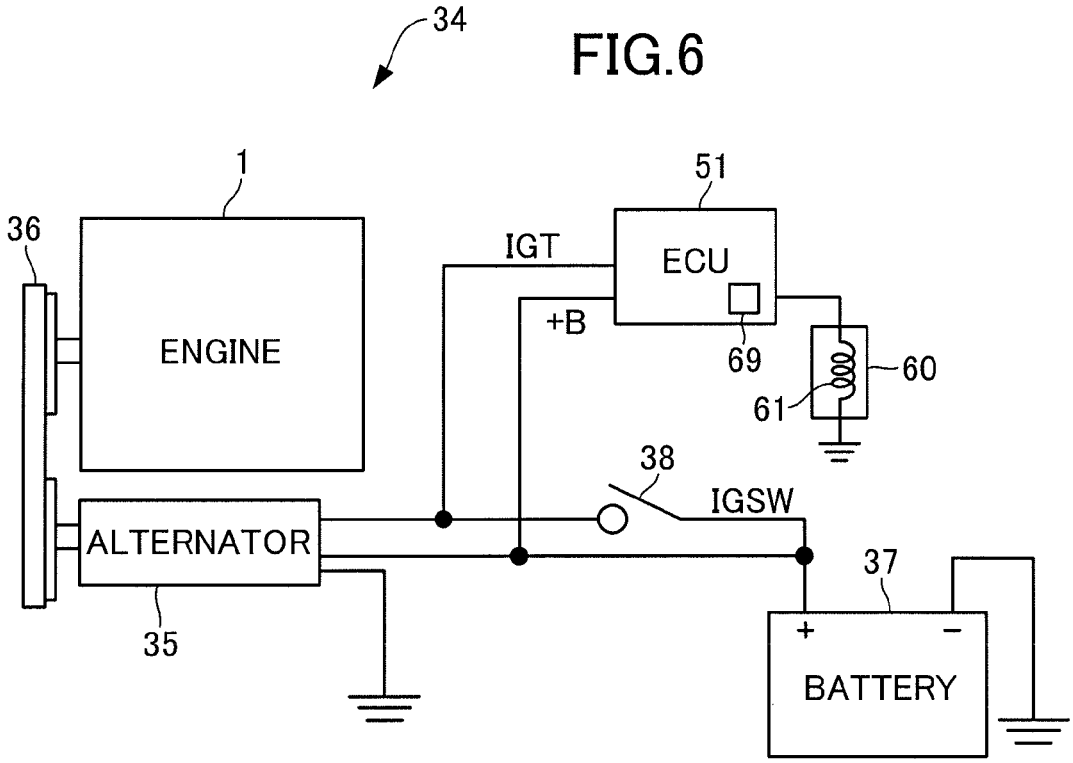
FIG. 6 is a circuit view of an electric power supply unit and the peripheral portion thereof according to the first embodiment of the present invention.

The ECU 51 in the present embodiment is designed to detect the electromotive force of the alternator 35. FIG. 6 is a circuit view of an electric power supply unit 34 and the peripheral portion thereof according to the present embodiment.

The electric power supply unit 34 has an alternator 35 mechanically connected with the engine 1, and a battery 37 electrically connected with the alternator 35. The alternator 35 is connected with the engine 1 through a belt 36, so that the drive force from the engine 1 can be inputted to the alternator 35 through the belt 36.

The alternator 35 is constructed by a stator coil serving as a stator not shown, a rotor coil serving as a rotor, a commentator and a regulator. The rotor coil is connected with the one end of an ignition switch 38 through the regulator. The other end of the ignition switch 38 is connected with the battery 37, so that when the ignition switch 38 comes to be in the "ON" state, the rotor coil is energized by battery 37 through the regulator to be magnetized. The drive force produced by the engine 1 is inputted to the rotor coil, so that when the rotor coil is rotated in conjunction with rotation of the engine 1, there is caused alternative electric pressure to the stator coil. The alternative electric pressure thus caused is converted by a rectifier into direct electric pressure which is in turn applied to the battery 37 as the electromotive pressure of the alternator 35.

The electromotive force of the alternator 35 is variable in response to the engine rotation number Ne. In the case of the engine rotation number Ne being at a high rotation number, the electromotive force of the alternator 35 is for example in the neighborhood of 14 [V]. On the other hand, in the case of the engine rotation number Ne being at a low rotation number, the electromotive force of the alternator 35 is for example in the neighborhood of 8 [V].

The alternator 35 is connected with the ECU 51 to enable the electromotive force of the alternator 35 to be inputted into the ECU 51. The electromagnet coil 61 (see FIG. 2) of the changeover valve 60 is connected with the ECU 51 to enable the electric pressure to be applied to the electromagnet coil 61 in response to the electromotive force of the alternator 35. This means that the electric pressure applied to the electromagnet coil 61 of the changeover valve 60 can be obtained by detecting the electromotive force of the alternator 35.

The ECU 51 has a transistor 69 to be controlled by the CPU 52 (see FIG. 5). The transistor 69 is adapted to take any one of an "ON" state in which the electromotive force of the alternator 35 is applied to the electromagnet coil 61 of the changeover valve 60, and an "OFF" state in which the electromotive force of the alternator 35 is not applied to the electromagnet coil 61 of the changeover valve 60.

Figure 7:
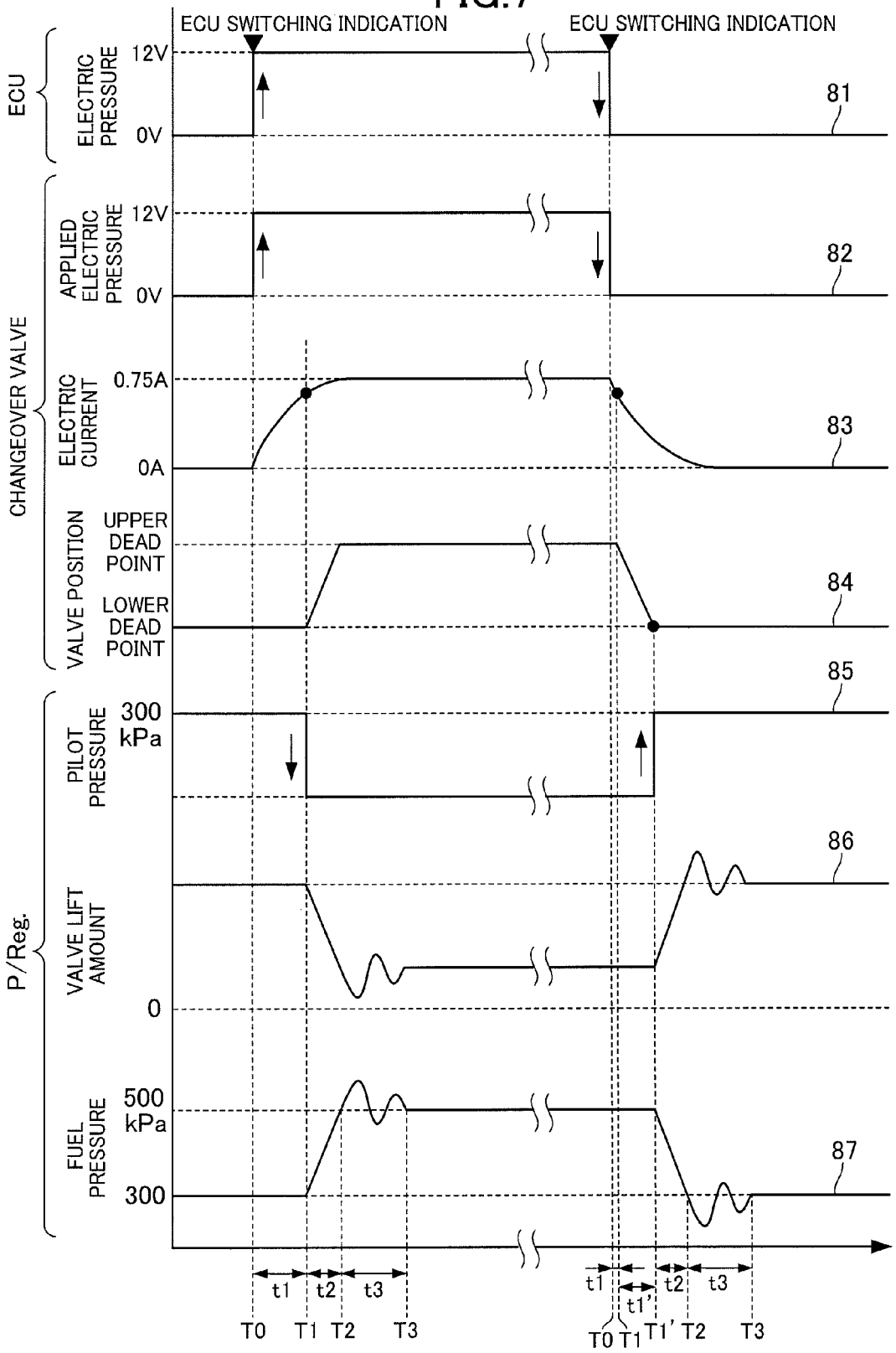
FIG. 7 is a timing chart of the fuel supply apparatus according to the first embodiment of the present invention.

FIG. 7 is a timing chart showing the operation of the fuel supply apparatus 8 constructed as explained in the foregoing description. The following explanation will be directed in FIG. 7 to the aspect in which the fuel pressure is changed from the low pressure side to the high pressure side. The example will be raised for explanation about the electromotive force Eb of the alternator 35 being 12 [V].

First, the ECU 51 judges that there is generated a fuel pressure change request for changing the fuel pressure from the low pressure side to the high pressure side before the time TO in accordance with the travel condition of the vehicle. When the ECU 51 detects the electromotive force Eb of the alternator 35, the ECU 51 is operated to have the transistor 69 take the "ON" state (see the solid line 81) at the time T0 set as stated below, so that the electromotive force of the alternator 35 is applied to the electromagnet coil 61 of the changeover valve 60.

When the transistor 69 comes to be in the "ON" state, the electric pressure to be applied to the electromagnet coil 61 becomes 12[V] from 0[V] (see the solid line 82). When, under this condition, the electromotive force Eb of the alternator 35 is applied to the electromagnet coil 61 of the changeover valve 60, the electric current "I" to be supplied to the electromagnet coil 61 of the changeover valve 60 can be given by the following equation (1).

$$I(t)=Eb/R(1-\exp(-t/\tau)) \quad (1)$$

Here, "Eb" represents the electromotive force of the alternator 35, and "τ" represents time constant with L/R. Further, "R" indicates electric resistance of the electromagnet coil 61, and the "L" indicates inductance of the electromagnet coil 61.

As will be seen from the foregoing equation, the electric current "I" to be supplied to the electromagnet coil 61 is raised in response to the responsibility property represented by the equation (1) (see the solid line 83). When the electric current "I" thus raised is supplied to the electromagnet coil 61, the attractive force "F" to be applied to the valve 67 of the changeover valve 60 can be given by the following equation (2).

$$F=\Phi^2/(2\,\mu S) \quad (2)$$

In the equation (2), "μ" represents magnetic permeability which can be obtained by multiplying vacuum magnetic permeability and relative magnetic permeability. In addition, "S" represents the cross-sectional area of magnetic passage. Further, "Φ" indicates magnetic flux in a magnetic gap which can be given by the following equation (3).

$$\Phi=n(I/R) \quad (3)$$

In the equation (3), "n" indicates the turn number of the electromagnet coil 61, and "I" and "R" respectively indicate electric current and magnetic resistance to be obtained by the above equation (1).

From the foregoing description, it will be understood that as the electric current "I" to be supplied to the electromagnet coil 61 is increased, the attractive force of the electromagnet coil 61 to the valve 67 is increased as represented by the equation (2).

When the attractive force of the electromagnet coil 61 to the valve 67 is increased to be larger than the urging force of the compression coil spring 62 to the valve 67 at the time T1, the valve 67 starts to move from the lower dead point, where the seal portion 64 of the valve 67 is engaged with the opening end portion 70, toward the upper dead point spaced apart from the lower dead point (see the solid line 84). As a result, the fuel pressure in the operation pressure fuel introduction passage **32*h* of the pressure regulator 20, i.e., the pilot pressure is lowered to the atmospheric pressure from 300 [kPa] (see the solid line 85**).

For this reason, the movable valve body portion 25 of the pressure regulator 20 is displaced in the direction to take its closing state by way of what is called "overshoot" (see the solid line 86) to have the fuel passing through the fuel passage 15 become at a high pressure (see the solid line 87).

The property relating to the overshoot amount and the displacement fluctuation of the movable valve body portion 25 is dependent on the structure of the pressure regulator 20, and thus can be obtained through the measurements of the preliminarily conducted experiments. In contrast, the time T1 when the valve 67 of the changeover valve 60 starts to move from the lower dead point to the upper dead point takes different values as shown in the equation (1) due to the fact that the electric current "I" to be supplied to the electromagnet coil 61 is varied in response to the electric pressure Eb applied to the electromagnet coil 61. This means that the time t1 is fluctuated from the time T0 to the time T1 by the electromotive force Eb of the alternator 35.

The ECU 51 according to the present embodiment is therefore designed to estimate the time T1, and to control the change timing of the fuel pressure based on the estimated time T1, and to adjust the fuel injection timing for the fuel injection control by detecting the electromotive force Eb of the alternator 35 when the fuel pressure is changed from the low pressure side to the high pressure side. Here, the electromotive force Eb of the alternator 35 according to the present embodiment means an electric property defined in the present invention.

The electric pressure detection unit of the ECU 51 is adapted to be capable of detecting the electromotive force Eb of the alternator 35 as needed. This means that the ECU 51 is operative to have the electric pressure detection unit detect the electromotive force Eb of the alternator 35 at the time of the change request of the fuel pressure being generated and to estimate the variation of the electric current "I" to be supplied to the electromagnet coil 61 based on the detected electromotive force Eb at the time of the change of the fuel pressure being started.

As will be appreciated from the foregoing description, the time variation of the electric current "I" to be supplied to the electromagnet coil 61 is estimated, thereby obtaining the attractive force F on the valve 67 of the changeover valve 60, so that the ECU 51 can estimate the timing of starting the movement of the changeover valve 60 from the "OFF" state to the "ON" state, viz., the timing of starting the movement of the valve 67.

Figure 8:
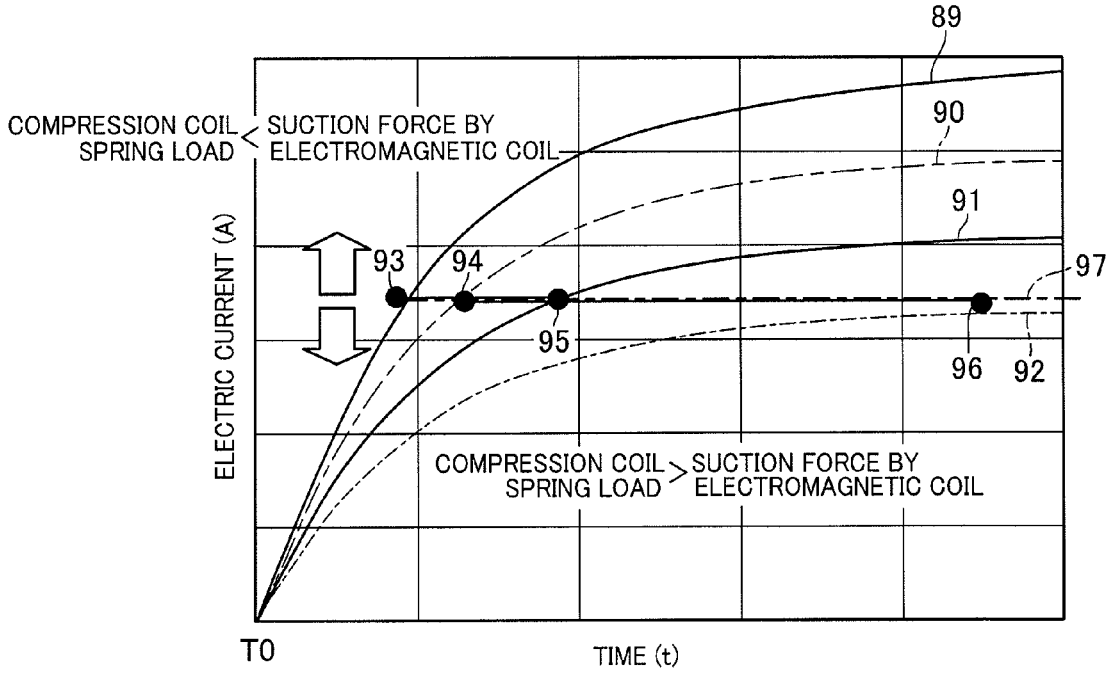
FIG. 8 is a graph showing an electric current property of the changeover valve forming part of the fuel supply apparatus according to the first embodiment of the present invention.

FIG. 8 is a graph showing the time interval from the time when the electric pressure Eb is applied to the electromagnet coil 61 to the time when the valve 67 starts to move in the changeover valve 60 having the electric property represented by the above equation (1).

The lines 89 to 92 respectively indicate the temporal variations of the electric current "I" (t) in 14[V], 12[V], 10[V], and 8[V] of the electromotive force Eb of the alternator 35 which can be obtained through the calculation. On the other hand, the points 93 to 96 respectively indicate the times really counted from the time when the electric pressure is applied to the electromagnet coil 61 at 14[V], 12[V], 10[V], and 8[V] of the electromotive force Eb of the alternator 35 to the time when the valve 67 starts to move.

The valve 67 of the changeover valve 60 starts to move when the attractive force caused by the electromagnet coil 61 becomes larger than the urging force caused by the compression coil spring 62. The chain line 97 in FIG. 8 indicates the value of the electric current when the urging force of the compression coil spring 62 is balanced with the attractive force of the electromagnet coil 61. In the upstream area from the chain line 97 where the attractive force of the electromagnet coil 61 becomes larger than the urging force of the compression coil spring 62, the valve 67 takes the open state.

As shown in FIG. 8, data acquired through the calculation and the real count previously mentioned regarding the relationship between the magnitude of the electromotive force Eb of the alternator 35 and the timing when the valve 67 starts to move, viz., the switching delay time t1 from the time T0 to the time T1 obtained by the calculation match with each other. It will therefore be understood that there is a relative relationship between the switching delay time and the electromotive force Eb.

Figure 9:
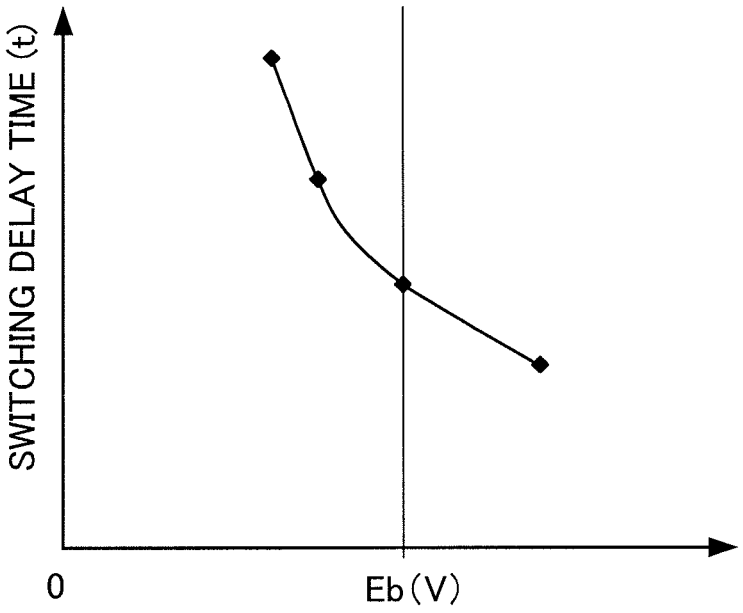
FIG. 9 is a switching delay time map showing the relationship between an electromotive force Eb and a switching delay time generated in an alternator forming part of the fuel supply apparatus according to the first embodiment of the present invention.

FIG. 9 is a switching delay time map showing the electromotive force Eb of the alternator 35 and the switching delay time t1 related with each other. The switching delay time map is prepared in accordance with the experimental results as shown in FIG. 8. The ECU 51 has the ROM 54 preliminarily memorize the switching delay time map showing the relationship between the electromotive force Eb of the alternator 35 and the switching delay time t1. The ECU 51 is adapted to calculate the switching delay time t1 with reference to the switching delay time map when the ECU 51 acquires the signal indicative of the electromotive force Eb of the alternator 35.

Here, the injection amount of the fuel injected in each of the combustion chambers of the cylinders 5 when each of the injectors 3 are opened can be obtained in response to the opening time and the fuel pressure of each of the injectors 3.

Figure 10:
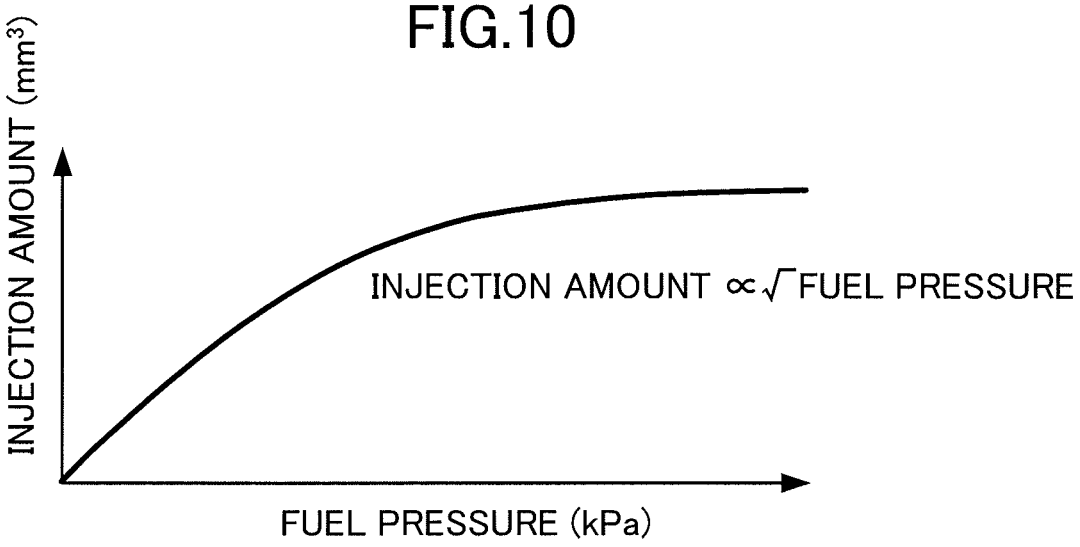
FIG. 10 is a graph showing the relationship between the fuel pressure and the fuel injection amount generated in the fuel supply apparatus according to the first embodiment of the present invention.

FIG. 10 is a graph showing the relationship between the fuel pressure and the fuel injection amount when the opening times of the injectors 3 are identical to each other. As shown in FIG. 10, the fuel injection amount by each of the injectors 3 is in proportion to the square root of the fuel pressure. For this reason, the ECU 51 is adapted to set the opening time of the injector 3 in response to the fuel pressure when the fuel amount to be supplied to each of the combustion chambers of the cylinders 5 is calculated based on the vehicle speed and the accelerator opening degree.

When the fuel pressure is transferred from the low pressure side to the high pressure side, and the fuel injection is performed by the injector 3 at the time of the fuel pressure being fluctuated in the neighborhood of the high pressure side, viz., before the fuel pressure coming to be in a steady pressure state, whereupon the fuel pressure is completely not matched to the target high pressure, the target fuel injection amount and the real fuel injection amount comes to be different from each other. This results in the fact that the real air-fuel ratio comes to be different from the target air-fuel ratio, thereby causing a possibility of deteriorating the fuel consumption and lowering the property of the exhaust gas purification.

For this reason, the fuel supply apparatus 8 according to the present invention is constructed to have the ECU 51 calculate the switching delay time t1 by the previously mentioned method, and to carry out a cooperative control for cooperatively executing the fuel pressure change control of estimating the time of the fuel pressure being transferred from the low pressure side to the high pressure side, and the fuel injection control of controlling the timing of the fuel injection, thereby making it possible to supply the desired injection amount of fuel to each of the combustion chambers. The fuel supply apparatus constructed in the above can suppress the real air-fuel ratio from being differentiated from the target air-fuel ratio as well as suppress the fuel consumption from deteriorating and the exhaust gas purification property from being lowered.

For performing the cooperative control, the ECU 51 is adapted to calculate the time interval from the time when the transistor 69 is transferred to the "ON" state for example by the fuel pressure change control to the time when the fuel pressure is completely transferred from the low pressure side to the high pressure side, and to calculate the timing of the following fuel injection by the fuel injection control. Therefore, the timing to have the transistor 69 come to be in the "ON" state is set in accordance with the timing of the fuel injection thus calculated to have the transfer of the fuel pressure finished.

In this case, the smaller is the electromotive force of the alternator 35, the longer becomes the time interval from the time when the transistor 69 is in the "ON" state to the time when the valve 67 starts to be moved. Therefore, the ECU 51 is adapted to make earlier the timing to have the transistor 69 become in the "ON" state in response to the electromotive force Eb of the alternator 35 becoming smaller, thereby suppressing the time to finish the change of the fuel pressure from being delayed.

Next, the fuel pressure change control process according to the present embodiment will be described hereinafter with reference to FIG. 11. The following process is executed at the predetermined timing by the CPU 52 constituting the ECU 51, while the preliminarily designed program is realized by the CPU 52.

Figure 11:
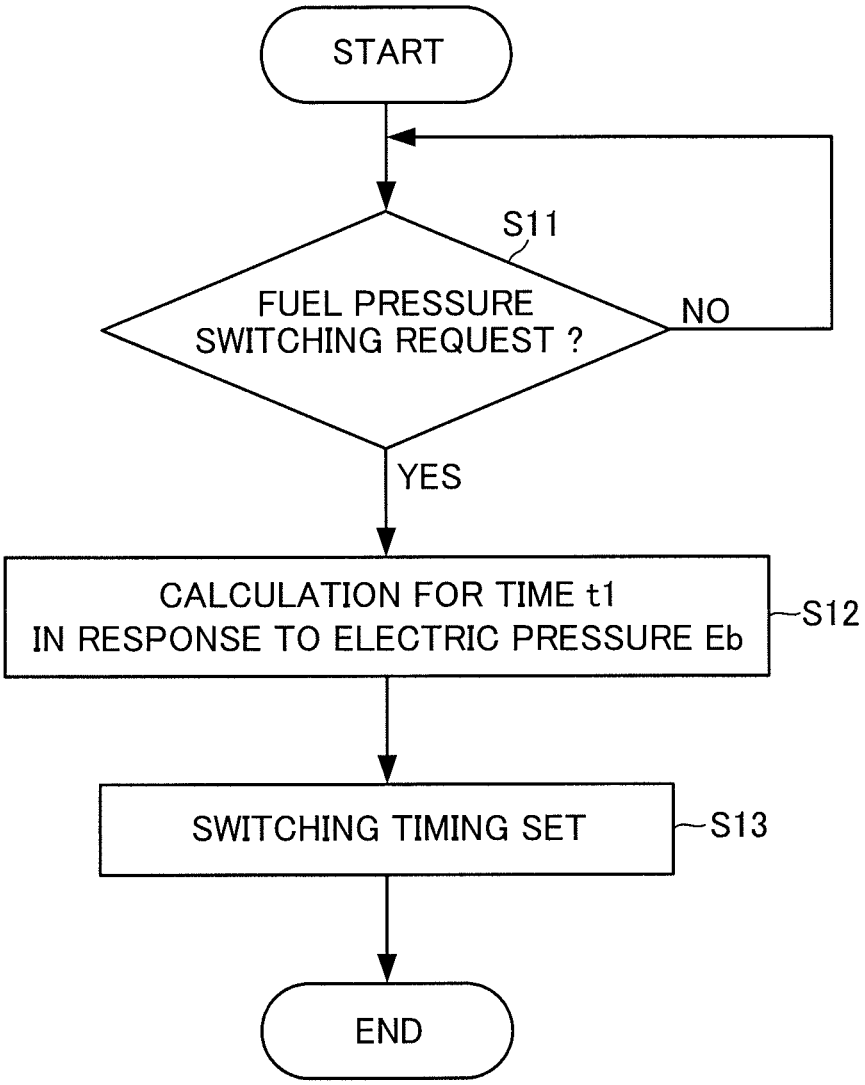
FIG. 11 is a flow chart showing the fuel pressure change control process in the fuel supply apparatus according to the first embodiment of the present invention.

As shown in FIG. 11, the ECU 51 is initially operated to acquire the signal indicative of the travel state of the vehicle to determine whether or not the fuel pressure change request is generated (Step S11). More specifically, the ECU 51 determines whether or not the vehicle is in the warming-up state, or whether or not the fuel is at the high temperature based on the signals inputted from the various sensors such as the cooling water temperature sensor 45, the fuel temperature sensor 47 and other sensors.

When the ECU 51 determines that the vehicle is in the warming-up state, or that the fuel is at the high temperature, the fuel pressure is maintained in the high pressure state. When, on the other hand, the ECU 51 determines that the vehicle is not in the warming-up state, or that the fuel is not at the high temperature, the fuel pressure is maintained in the low pressure state.

When the fuel pressure is at the low pressure side, and the ECU 51 determines that the vehicle is in the warming-up state, or that the fuel is at the high temperature, the ECU 51 determines that the fuel pressure change request is generated.

When the ECU 51 determines that the fuel pressure change request is generated ("YES" in Step S11), the ECU 51 moves to Step 12. When the ECU 51 determines that the fuel pressure change request is not generated ("NO" in Step S11), the ECU 51 returns to "START".

Next, the ECU 51 calculates the switching delay time t1 (Step S12). More specifically, the ECU 51 is operated to have the electric pressure detection unit detect the electromotive force Eb of the alternator 35. The ECU 51 calculates the switching delay time t1 in accordance with the switching delay time map previously mentioned.

The ECU 51 is then operated to set the change timing in such a manner that the timing of injecting the fuel is not overlapped with the timing of the fuel pressure change with reference to the injection timing of the fuel injection control (Step S13). In this case, the ECU 51 is operated to have the change timing set earlier in response to the electromotive force Eb of the alternator 35 smaller as previously mentioned, so that the fuel injection timing can be avoided from coming in at the time before the fuel pressure change is finished. In lieu of the method of setting the change timing in order to avoid the fuel pressure change from being overlapped with the timing of injecting the fuel, another method of setting the change timing to have the fluctuation of the fuel pressure lowered below the predetermined value at the timing of injecting the fuel may be used according to the present invention.

As has been explained in the above description, the fuel supply apparatus 8 according to the first embodiment of the present invention can operate the ECU 51 to alter the timing of the fuel pressure change control to the changeover valve 60 in response to the electric property inputted into the changeover valve 60. Therefore, even in the case of the different times of changing the states of the changeover valve 60 in response to the electric property, the fuel supply apparatus 8 can make the change timings variable, thereby making it possible to reduce the effect to the fuel injection control. For this reason, the timings of performing the fuel pressure change indication and the fuel injection timing are optimized, thereby making it possible to suppress the real fuel injection amount from being differentiated from the target fuel injection amount even at the time of the fuel pressure being changed. Further, the fuel supply apparatus 8 can enhance the degree of accuracy of the fuel injection control and can accomplish the improvement of the fuel consumption.

Further, the ECU 51 is operated to make early the switching timing of the changeover valve 60 when the changeover valve 60 start switching later as compared with the changeover valve 60 starting switching earlier, thereby making it possible to reduce the effect of electric property imparted to the fuel injection control to a level as low as possible. The present embodiment thus constructed is set to make early the switching timing of the changeover valve when the changeover valve has a delay switch starting value as compared with when the changeover valve has an early switch starting value, thereby making it possible to reduce the effect imparted to the fuel injection control by the electric property to a level as low as possible.

The ECU 51 can calculate the switching timing of changing the state of the changeover valve 60 in accordance with the magnitude of the electromotive force Eb of the alternator 35. This makes it unnecessary to directly detect the fuel pressure of the fuel to be supplied to the injector 3, thereby making it unnecessary to provide a sensor for detecting the fuel pressure. Therefore, the fuel supply apparatus can enhance the degree of accuracy of the fuel pressure change control even if the fuel supply apparatus can be produced at a low cost.

The ECU 51 can set the timing of starting to change the states of the changeover valve 60 based on the electric property. This leads to the fact that the times required to change the states of the changeover valve 60 and the time interval from the time when the fuel pressure is changed to the time when the fuel pressure is returned to the steady pressure state can be preliminarily measured, thereby making it possible to estimate the time of reaching the steady pressure state of the fuel pressure.

Further, the pressure adjustment member 22 has a fuel pressure receiving area variable to enable the fuel pressure to be adjusted at two stages. This makes it unnecessary to divide the inside of the pressure regulator 20 into three chambers, or otherwise to provide two pressure regulators 20 in the fuel supply apparatus, but makes it possible to control the fuel pressure to be supplied to the injector 3 at two stages. For this reason, it is possible to downsize the fuel supply apparatus 8.

The above explanation has been directed to the case in which the ECU 51 is operative to have the fuel pressure changed from the low pressure side to the high pressure side. As will be explained hereinafter about the second embodiment, the ECU 51 may, however, be operative to similarly execute the fuel pressure change control of having the fuel pressure changed from the high pressure side to the low pressure side.

(Second Embodiment)

The fuel supply apparatus 8 according to the second embodiment will be explained hereinafter with reference to FIGS. 1 to 7. The following explanation will be made hereinafter about the constitution parts and elements forming the second embodiment the same as those of the first embodiment referring to the same reference numerals as those of the first embodiment. In particular only about the aspects of the second embodiment different from those of the first embodiment will be described in The fuel supply apparatus 8 according to the present embodiment is provided with the constitution parts and elements the same as those of the first embodiment as shown in FIGS. 1 to 6.

The ECU 51 according to the present embodiment is operative to execute the fuel pressure change control for decreasing the fuel pressure to the low pressure side from the high pressure side when the warming-up of the vehicle is terminated, and the fuel temperature is lowered in the state that the fuel pressure is set at the high pressure side for the warming-up operation of the vehicle and for the high fuel temperature.

The operation of the fuel supply apparatus 8 thus constructed will be explained hereinafter with reference to the timing chart shown in FIG. 7. The following explanation will be made raising an example in which the electromotive force Eb of the alternator 35 is 12[V]. The present embodiment shown in FIG. 7 will be explained focusing the point where the fuel pressure is changed from the high pressure side to the low pressure side.

The ECU 51 is operative to decide that there is generated a fuel pressure change request to change the fuel pressure from the high pressure side to the low pressure side when the warming-up of the vehicle is terminated, and the fuel temperature is lowered in the state that the fuel pressure is set at the high pressure side for the warming-up operation of the vehicle and for the high fuel temperature.

The ECU 51 is operative to transfer the transistor 69 from the "ON" state to the "OFF" state (see the solid line 81) so as to block the electromotive force of the alternator 35 applied to the electromagnet coil 61 of the changeover valve 60 at the time T0 set as will become apparent as the description proceeds.

When the transistor 69 comes to be in the "OFF" state, the electric pressure applied to the electromagnet coil 61 becomes 0[V] from 12[V] (see the solid line 82). At this time, the electric pressure applied to the electromagnet coil 61 of the changeover valve 60 becomes 0[V] from Eb[V], while the electric current "I" (t) supplied to the electromagnet coil 61 of the changeover valve 60 is represented by the following equation (4).

$$I(t)=Eb/R\cdot\exp(-t/\tau) \quad (4)$$

As will be seen from the foregoing equation, the electric current "I" to be supplied to the electromagnet coil 61 is lowered in response to the responsibility property represented by the equation (4) (see the solid line 83).

The attractive force "F" to be applied to the valve 67 of the changeover valve 60 can be given by the following equations (2) and (3). When the electric current "I" to be supplied to the electromagnet coil 61 is lowered in line with the equation (4), the attractive force of the electromagnet coil 61 to the valve 67 is reduced in line with the equation (2).

When the attractive force of the electromagnet coil 61 to the valve 67 becomes smaller than the urging force of the compression coil spring 62 to the valve 67 at the time T1, the seal portion 64 of the valve 67 starts to move in a direction toward the lower dead point from the upper dead point spaced apart from the opening end portion 70 (see the solid line 84).

When the valve seat 64 of the valve 67 is brought into engagement with the opening end portion 70 at the time T1' (see the solid line 84), the fuel pressure in the operation pressure fuel introduction passage 32*h* of the pressure regulator 20, i.e., the pilot pressure is raised to 300 [kPa] from the atmospheric pressure (see the solid line 85).

For this reason, when the fuel pressure of the fuel flowing in the fuel passage 15 temporally reaches the low pressure targeted at the time T2 in response to the opening direction displacement of the movable valve body portion 25 of the pressure regulator 20, the fuel pressure of the fuel is lowered to the low pressure (see the solid line 87) by way of what is called "overshoot" (see the solid line 87).

Similarly to the first embodiment, the overshoot amount and the displacement fluctuation of the movable valve body portion 25 can be obtained through the measurements of the preliminarily conducted experiments. The time t1' (time interval T1 to T1') taken for the valve 67 of the changeover valve 60 to reach from the upper dead point to the lower dead point can also be obtained through the measurements of the preliminarily conducted experiments. In contrast, the time T1 when the valve 67 of the changeover valve 60 starts to move from the lower dead point to the upper dead point is fluctuated due to the fact that the electric current "I" to be supplied to the electromagnet coil 61 is varied in response to the electric pressure Eb applied to the electromagnet coil 61 at the time of the fuel pressure being changed at the time of starting to change the fuel pressure from the high pressure side to the low pressure side and vice versa as shown in the above equation (4). This means that the time T1 is varied by the electromotive force of the alternator 35.

For this reason, the fuel supply apparatus 8 according to the present embodiment is constructed to have the ECU 51 detect the electromotive force Eb of the alternator 35 to estimate the time T1 when the fuel pressure is changed from the high pressure side to the low pressure side, so that the ECU 51 can control the change timing of the fuel pressure based on the estimated time T1, and can carry out a cooperative control for adjusting the timing of the fuel injection in the fuel pressure change control.

The electric pressure detection unit of the ECU 51 is adapted to be capable of detecting the electromotive force Eb of the alternator 35 as needed. This means that the ECU 51 is operative to have the electric pressure detection unit detect the electromotive force Eb of the alternator 35 at the time of the change request of the fuel pressure being generated and to estimate the variation of the electric current "I" to be supplied to the electromagnet coil 61 based on the detected electromotive force Eb at the time of the change of the fuel pressure being started. It will therefore be appreciated that the electromotive force Eb of the alternator 35 constitutes the electric property defined in the present invention.

The attractive force F on the valve 67 of the changeover valve 60 can be obtained from the electric current "I" supplied to the electromagnet coil 61, so that the ECU 51 can estimate the timing of starting the movement of the changeover valve 60 from the "ON" state to the "OFF" state.

Figure 12:
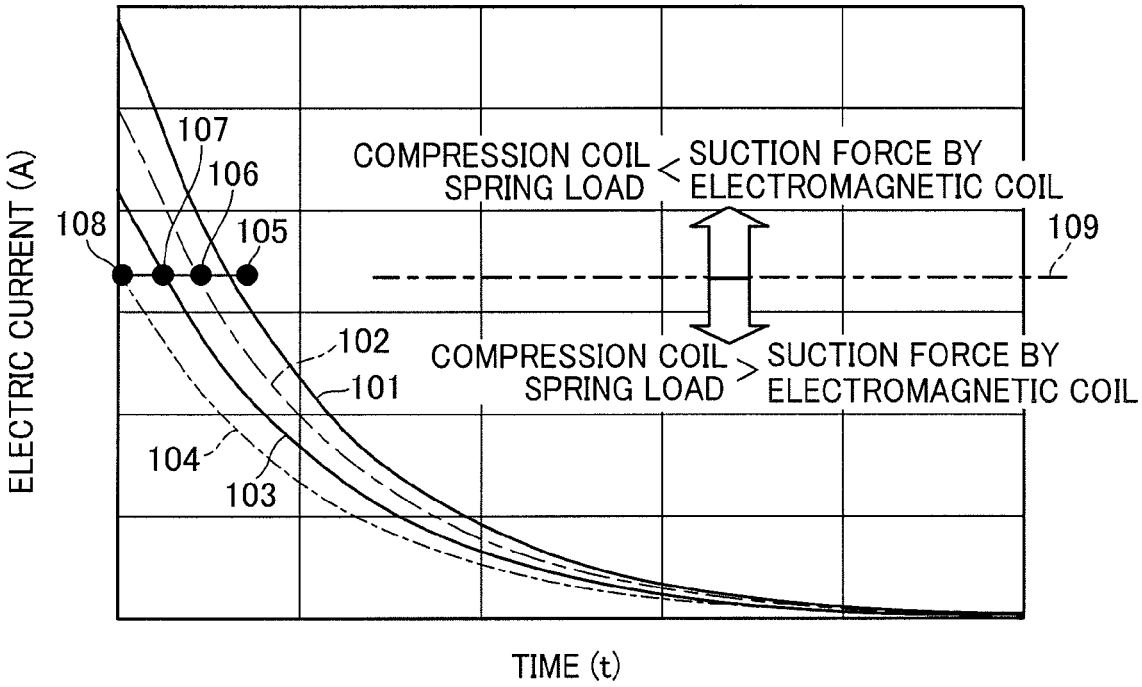
FIG. 12 is a graph showing an electric current property of the changeover valve forming part of the fuel supply apparatus according to the second embodiment of the present invention.

FIG. 12 is a graph showing the time interval to the time when the valve 67 starts to move from the time when the electric pressure applied to the electromagnet coil 61 of the changeover valve 60 having the electric property obtained from the above equation (4) comes to be in the "OFF" state.

The lines 101 to 104 respectively indicate the temporal variations of the electric current "I(t)" in 14[V], 12[V], 10[V], and 8[V] of the electromotive force Eb of the alternator 35 which can be obtained through the calculation. On the other hand, the points 105 to 108 respectively indicate the times really counted from the time when the electric pressure applied to the electromagnet coil 61 becomes the "OFF" state with 14[V], 12[V], 10[V], and 8[V] of the electromotive force Eb of the alternator 35 to the time when the valve 67 starts to move.

The valve 67 of the changeover valve 60 starts to move when the urging force caused by the compression coil spring 62 becomes larger than the attractive force caused by the electromagnet coil 61. The chain line 109 in FIG. 12 indicates the value of the electric current when the urging force of the compression coil spring 62 is balanced with the attractive force of the electromagnet coil 61. In the lower side area from the chain line 109 where the urging force of the compression coil spring 62 becomes larger than the attractive force of the electromagnet coil 61, the valve 67 takes the closed state.

As shown in FIG. 12, data acquired through the calculation and the real count previously mentioned regarding the relationship between the magnitude of the electromotive force Eb of the alternator 35 and the switching delay time t1 from the timing when the transistor 69 is transferred to the "OFF" state to the timing when the valve 67 starts to move match with each other. This means that there is a relative relationship between the switching delay time and the electromotive force Eb.

Figure 13:
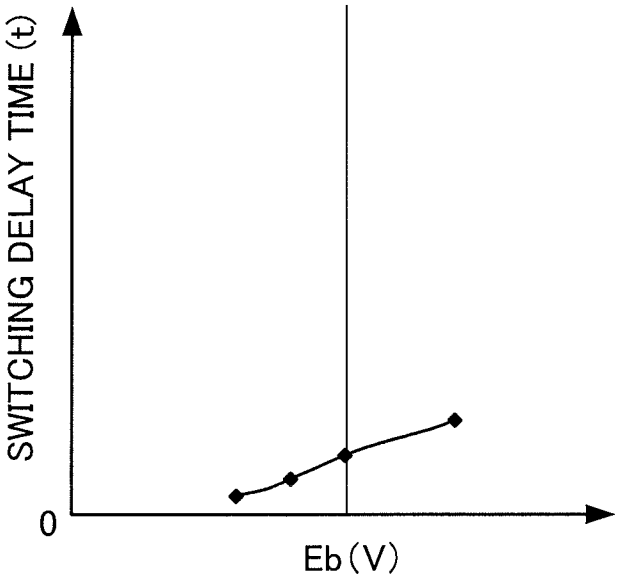
FIG. 13 is a switching delay time map showing an electromotive force Eb and a switching delay time generated in an alternator forming part of the fuel supply apparatus according to the second embodiment of the present invention.

FIG. 13 is a switching delay time map showing the electromotive force Eb of the alternator 35 and the switching delay time t1 related with each other. The ECU 51 has the ROM 54 preliminarily memorize the switching delay time map showing the relationship between the electromotive force Eb of the alternator 35 and the switching delay time t1. The ECU 51 is adapted to calculate the switching delay time t1 with reference to the switching delay time map when the ECU 51 acquires the signal indicative of the electromotive force Eb of the alternator 35.

Here, the injection amount of the fuel injected in each of the combustion chambers of the cylinders when each of the injectors 3 are opened can be obtained in response to the opening time and the fuel pressure of each of the injectors 3. For this reason, the ECU 51 is adapted to set the opening time of the injector 3 in response to the fuel pressure when the fuel amount to be supplied to each of the combustion chambers of the cylinders 5 is calculated in the combustion step of each of the cylinders 5 based on the vehicle speed and the accelerator opening degree.

For this reason, the fuel supply apparatus 8 according to the present invention is constructed to have the ECU 51 calculate the switching delay time t1 by the previously mentioned method, and to carry out a cooperative control for cooperatively executing the fuel pressure change control of estimating the time of the fuel pressure being completely transferred from the high pressure side to the low pressure side, and the fuel injection control of controlling the timing of the fuel injection, thereby making it possible to supply the desired injection amount of fuel to each of the combustion chambers. The fuel supply apparatus constructed in the above therefore can suppress the real air-fuel ratio from being differentiated from the target air-fuel ratio as well as suppressing the fuel consumption from deteriorating and the exhaust gas purification property from being lowered.

For performing the cooperative control, the ECU 51 is for example adapted to calculate the time interval from the time when the transistor 69 is transferred to the "OFF" state by the fuel pressure change control to the time when the fuel pressure is completely transferred from the high pressure side to the low pressure side, and to calculate the timing of the following fuel injection by the fuel injection control. The timing to have the transistor 69 come to be in the "OFF" state is set as the transfer of the fuel pressure has been finished at the timing of the fuel injection thus calculated.

In this case, the smaller is the electromotive force Eb of the alternator 35, the longer becomes the time interval from the time when the transistor 69 is in the "OFF" state to the time when the valve 67 starts to be moved. Therefore, the ECU 51 is adapted to make earlier the timing to have the transistor 69 become in the "OFF" state in response to the electromotive force Eb of the alternator 35 becoming smaller.

Next, the fuel pressure change control process according to the present embodiment will be described hereinafter with reference to FIG. 14. The following process is executed at the predetermined timing by the CPU 52 constituting the ECU 51, while realizing a program executed by the CPU 52.

Figure 14:
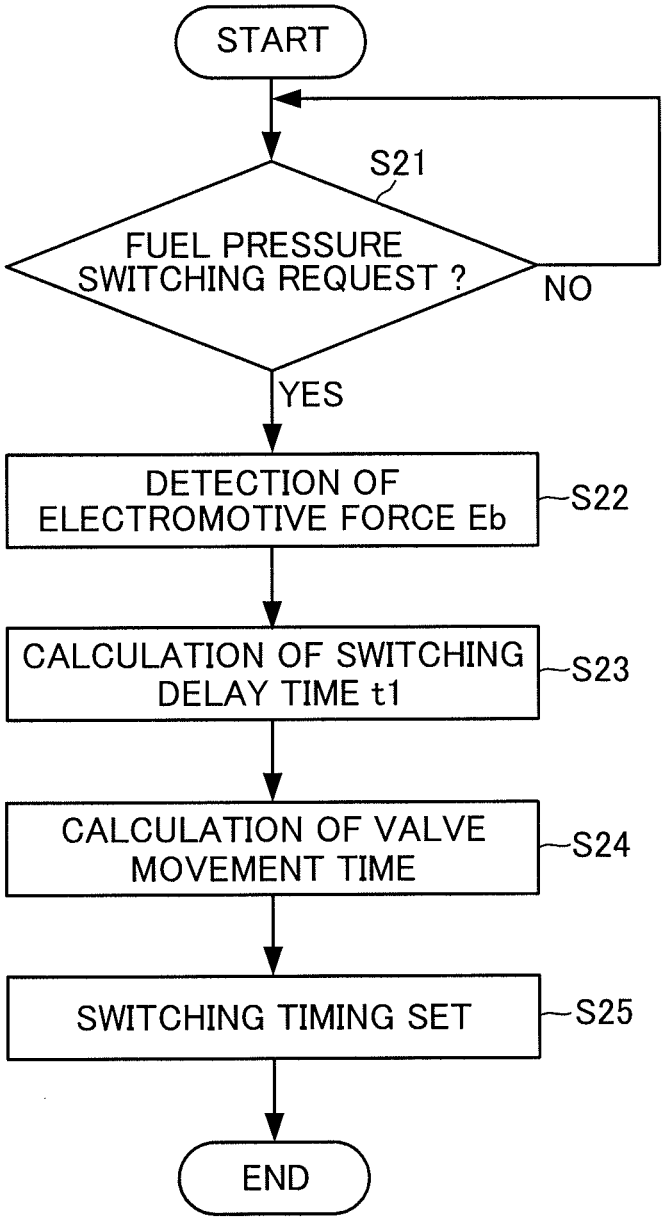
FIG. 14 is a flow chart showing the fuel pressure change control process in the fuel supply apparatus according to the second embodiment of the present invention.
Figure 15:
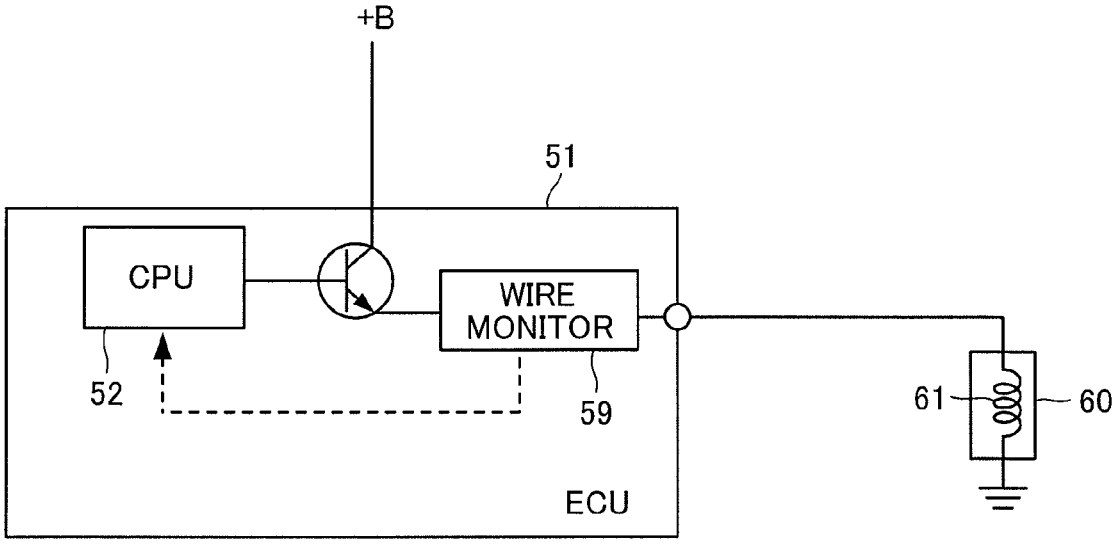
FIG. 15 is a schematic construction view of a wire breaking detection circuit in the fuel supply apparatus according to the third embodiment of the present invention.

As shown in FIG. 14, the ECU 51 is initially operated to acquire the signal indicative of the travel state of the vehicle to determine whether or not the fuel pressure change request is generated (Step S21). More specifically, the ECU 51 determines whether or not the vehicle is in the warming-up state, or whether or not the fuel is at the high temperature based on the signals inputted from the various sensors such as the cooling water temperature sensor 45, the fuel temperature sensor 47 and the other sensors. When the ECU 51 determines that the vehicle is in the warming-up state, or that the fuel is at the high temperature, the fuel pressure is maintained in the high pressure state. When, on the other hand, the ECU 51 determines that the vehicle is not in the warming-up state, or that the fuel is not at the high temperature, the fuel pressure is maintained in the low pressure state.

When the fuel pressure is at the high pressure side, and the ECU 51 determines that the vehicle is not in the warming-up state, or that the fuel is not at the high temperature, the ECU 51 determines that the fuel pressure change request is generated.

When the ECU 51 determines that the fuel pressure change request is generated ("YES" in Step S21), the ECU 51 moves to Step S22. When the ECU 51 determines that the fuel pressure change request is not generated ("NO" in Step S21), the ECU 51 returns to "START".

In Step S22, the ECU 51 is operated to detect the electromotive force Eb of the alternator 35. The ECU 51 then calculates the switching delay time t1 (Step S23). More specifically, the ECU 51 is operated to calculate the electromotive force Eb of the alternator 35 detected in Step S22, and the switching delay time t1 in accordance with the switching delay time map previously mentioned.

Next, the ECU 51 is operated to calculate the movement time of the valve 67 (Step S24). The movement time of the valve 67 does not depend on the electromotive force Eb of the alternator 35. For this reason, the ECU 51 is operated to have the ROM 54 memorize the movement time of the valve 67 which is preliminarily obtained through the measurements of the preliminarily conducted experiments. Further, the ECU 51 is operated to have the ROM 54 memorize the following time interval which is preliminarily obtained through the measurements of the preliminarily conducted experiments. The above time interval indicates the time interval from the time when the movement of the valve 67 is completed, and the fuel pressure is lowered from the high pressure side to the low pressure side to the time when the fluctuation of the fuel pressure is converged to the steady state.

The ECU 51 is then operated to set the change timing in such a manner that the timing of injecting the fuel is not overlapped with the timing of the fuel pressure change with reference to the injection timing of the fuel injection control (Step S25). In this case, the ECU 51 is operated to calculate the time interval required from the change starting time of the fuel pressure to the fluctuation convergence time of the fuel pressure by totaling the switching delay time t1 calculated in Step S23 and the time memorized in the ROM 54 in Step S24. The ECU 51 is then operated to have the change timing set earlier in response to the electromotive force Eb of the alternator 35 larger as previously mentioned, so that the fuel injection timing can be avoided from coming in at the time before the fuel pressure change is finished.

As has been explained in the above description, the fuel supply apparatus 8 according to the second embodiment of the present invention can operate the ECU 51 to alter the timing of the fuel pressure change control to the changeover valve 60 in response to the electric property inputted into the changeover valve 60. Therefore, even in the case of the different times of changing the states of the changeover valve 60 in response to the electric property, the fuel supply apparatus 8 can make the change timings variable, thereby making it possible to reduce the effect to the fuel injection control. For this reason, the timing of performing the fuel pressure change indication and the fuel injection timing is optimized, thereby making it possible to suppress the real fuel injection amount from being differentiated from the target fuel injection amount even at the time of the fuel pressure being changed. Further, the fuel supply apparatus 8 can enhance the degree of accuracy of the fuel injection control and can accomplish the improvement of the fuel consumption.

Further, the ECU 51 is operated to make early the switching timing of the changeover valve 60 when the changeover valve 60 start switching later as compared with the changeover valve 60 starting switching earlier, thereby making it possible to reduce the effect of electric property imparted to the fuel injection control to a level as low as possible. The present embodiment thus constructed is set to make early the switching timing of the changeover valve 60 when the electric property to the changeover valve 60 has a larger value as compared with when the electric property to the changeover valve 60 has a smaller value, thereby making it possible to reduce the effect imparted to the fuel injection control by the electric property to a level as low as possible.

The ECU 51 can calculate the switching timing of changing the state of the changeover valve 60 in accordance with the magnitude of the electromotive force Eb of the alternator 35. This makes it unnecessary to directly detect the fuel pressure of the fuel to be supplied to the injector 3, thereby making it unnecessary to provide a sensor for detecting the fuel pressure. Therefore, the fuel supply apparatus can enhance the degree of accuracy of the fuel pressure change control even if the fuel supply apparatus can be produced at a low cost.

The ECU 51 can set the timing of starting to change the states of the changeover valve 60 based on the electric property. This leads to the fact that the times required to change the states of the changeover valve 60 and the time interval from the time when the fuel pressure is changed to the time when the fuel pressure is returned to the steady pressure state can be preliminarily measured, thereby making it possible to estimate the time of reaching the steady pressure state of the fuel pressure.

Further, the pressure adjustment member 22 has a fuel pressure receiving area variable to enable the fuel pressure to be adjusted at two stages. This makes it unnecessary to divide the inside of the pressure regulator 20 into three chambers, or otherwise to provide two pressure regulator 20 in the fuel supply apparatus, but makes it possible to control the fuel pressure to be supplied to the injector 3 at two stages. For this reason, it is possible to downsize the fuel supply apparatus 8.

The above explanation has been directed to the case in which the ECU 51 is operative to refer to the timing of the fuel injection control when the ECU 51 calculate the switching delay time t1, and to make earlier the change timing to avoid the fuel pressure change from being overlapped with the timing of injecting the fuel in accordance with the injection timing and the calculated switching delay time. As will be explained hereinafter about the third embodiment, the ECU 51 may, however, in the case of the ECU 51 being able to detect the electric current to be supplied to the electromagnet coil 61, be operative to calculate the switching delay time t1 based on the detected results according to the present invention.

(Third Embodiment)

The fuel supply apparatus 8 according to the third embodiment will be explained hereinafter with reference to FIGS. 1 to 7, and FIGS. 15 and 16. The following explanation will be made hereinafter about the constitution parts and elements forming the third embodiment the same as those of the first embodiment referring to the same reference numerals as those of the first embodiment. In particular only about the aspects of the third embodiment different from those of the first embodiment will be described in detail hereinafter.

The fuel supply apparatus 8 according to the present embodiment is provided with the constitution parts and elements the same as those of the first embodiment as shown in FIGS. 1 to 6.

In the fuel supply apparatus 8 according to the third embodiment, the ECU 51 has a wire monitor 59 which constitutes a wire breaking detection unit defined in the present invention. The wire monitor 59 is designed to detect the magnitude of the electric current "I" to be supplied to the electromagnet coil 61 of the changeover valve 60, and to transmit to the CPU 52 a signal indicative of the detected result. In accordance with the signal transmitted to the CPU 52, the ECU 51 is operative to judge whether or not there is generated the breaking of an electric wire to the changeover valve 60.

When the fuel pressure change request is generated, the ECU 51 forming part of the present embodiment is operative to change the electric pressure applied to the electromagnet 61 of the changeover valve 60, and to acquire from the wire monitor 59 a signal indicative of the magnitude of the electric current "I" to be supplied to the electromagnet coil 61 of the changeover valve 60, thereby estimating the time interval that the changeover valve 60 is transferred from the closed state to the open state.

Figure 16:
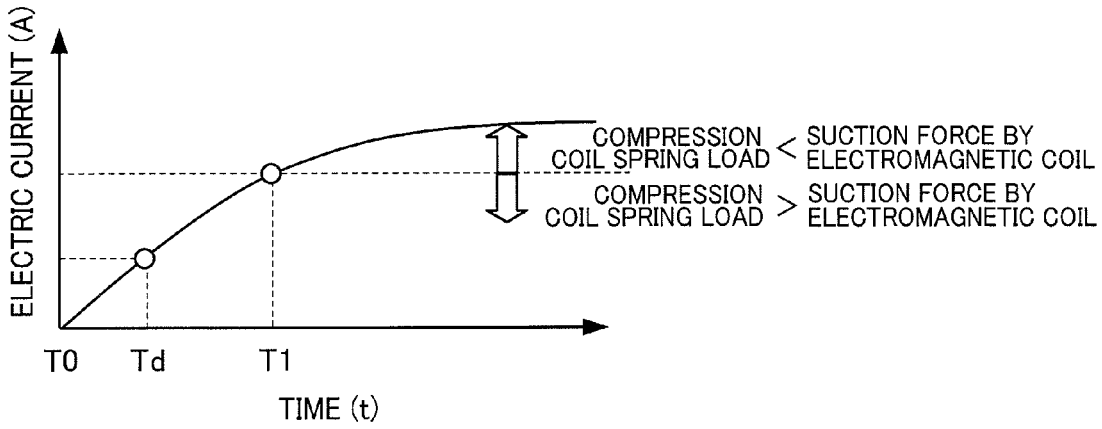
FIG. 16 is a graph showing an electric current property of the changeover valve forming part of the fuel supply apparatus according to the third embodiment of the present invention.

More specifically, the ECU 51 is, as shown in FIG. 16, operative to judge that the fuel pressure change request is generated at the time T0 to transfer the transistor 69 to the "ON" state from the "OFF" state. At this time, the electromotive force Eb of the alternator 35 is applied to the electromagnet coil 61, and the electric current "I(t)" to be supplied to the electromagnet coil 61 follows the equation (1) similarly to the first embodiment.

When the ECU 51 is operative to detect the value of the electric current "I" at the time Td immediately after the transistor 69 is transferred to the "ON" state from the "OFF" state, the ECU 51 is adapted to calculate the time T1 when the seal portion 64 of the valve 67 starts to move from the lower dead point where the seal portion 64 of the valve 67 is engaged with the opening end portion 70 toward the upper dead point spaced apart from the lower dead point. It is therefore to be noted that the electric current "I(t)" to be supplied to the electromagnet coil 61 forming part of the present embodiment constitutes the electric property defined in the present invention.

Further, the ECU 51 is, similarly to the first and second embodiments, adapted to preliminarily memorize in ROM 54 the time interval from the time T1 when the valve 67 starts to move to the time T3 when the fuel pressure comes to be in the high pressure steady state by way of the "overshoot".

The ECU 51 is, therefore, operative to detect the magnitude of the electric current "I" to be supplied to the electromagnet coil 61 at the time Td after the change request is generated, and to calculate the time when the fuel pressure in the fuel passage 15 comes to be in the high pressure steady state. In accordance with the time calculated, the ECU 51 is operative to adjust the fuel injection timing by the fuel injection control, thereby making it possible to inject the fuel in the state in which the fuel pressure is roughly matched with the target fuel pressure.

Next, the fuel pressure change control process according to the present embodiment will be described hereinafter with reference to FIG. 17. The following process is executed at the predetermined timing by the CPU 52 constituting the ECU 51, while the preliminarily designed program is realized by the CPU 52.

Figure 17:
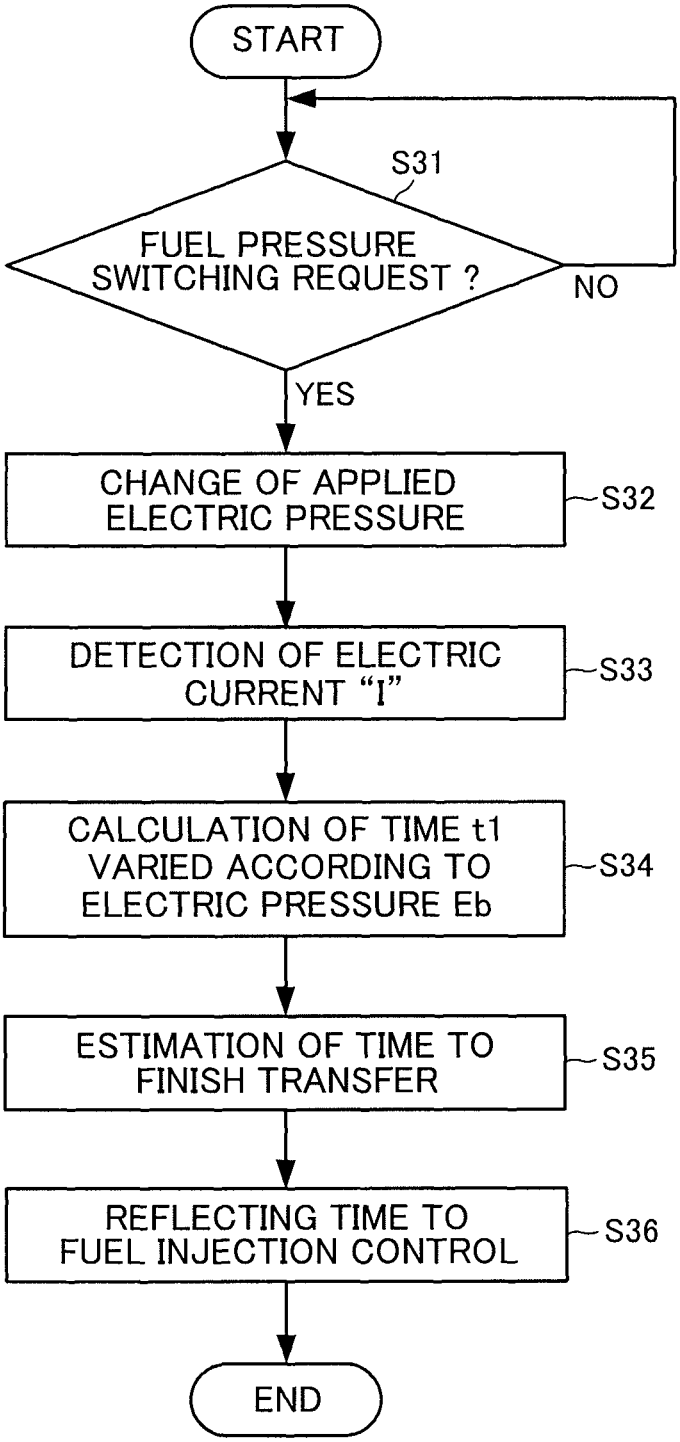
FIG. 17 is a flow chart showing the fuel pressure change control process in the fuel supply apparatus according to the third embodiment of the present invention.

As shown in FIG. 17, the ECU 51 is initially operative to judge whether or not the fuel pressure change request is generated (Step S31). The judge is performed for example in the similar manner to the Step S11 which has been described hereinbefore.

The ECU 51 is then operative to have the transistor 69 changed from the "OFF" state to the "ON" state, and to change the electric pressure to be applied to the electromagnet coil 61 of the changeover valve 60 (Step S32).

The ECU 51 is then operative to detect the electric current "I" to be supplied to the electromagnet coil 61 immediately after the electric pressure is changed (Step S33).

The ECU 51 is then operative to calculate the switching delay time t1 in accordance with the magnitude of the electric current detected in Step S33 (Step S34). The calculation of the switching delay time t1 is for example preliminarily experimentally measured in relationship with the value of the electric current at the time Td and the switching delay time t1. The ECU 51 is operative to memorize in the ROM 54 the switching delay map showing the above relational data. When the ECU 51 is operative to detect the value of the electric current in Step S33, the ECU 51 is operative to calculate the switching delay time t1 with reference to the switching delay time map memorized in the ROM 54.

Next, the ECU 51 is operative to estimate the time when the fuel pressure is transferred to the steady fuel pressure state (Step S35). As will be understood from the foregoing description, the time interval from the time when the valve 67 starts to move to have the fuel pressure varied to the time when the fuel pressure is transferred to the steady fuel pressure by way of the "overshoot" exceeding the target fuel pressure can be obtained by the preliminarily experimental measurement due to almost no effect imparted by the electromotive force Eb of the alternator 35.

The ECU 51 is then operative to refer the time calculated in Step S35 to the fuel injection control (Step S36). For example, the ECU 51 is operative to suspend the fuel injection until the time calculated in Step S35 elapses.

As has been explained in the above description, the fuel supply apparatus 8 according to the third embodiment of the present invention can operate the ECU 51 to calculate the time of the state of the changeover valve 60 being changed in response to the electric property inputted into the changeover valve 60. Therefore, even in the case of the different times of changing the states of the changeover valve 60 in response to the electric property, the fuel supply apparatus 8 can calculate the time of the state of the changeover valve 60 being changed, thereby making it possible to reduce the effect to the fuel injection control. For this reason, the timing of performing the fuel pressure change indication and the fuel injection timing is optimized, thereby making it possible to suppress the real fuel injection amount from being differentiated from the target fuel injection amount even at the time of the fuel pressure being changed. Further, the fuel supply apparatus 8 can enhance the degree of accuracy of the fuel injection control and can accomplish the improvement of the fuel consumption.

Further, the ECU 51 can estimate the time of the change state of the changeover valve 60 starting to be changed. The estimation by the ECU 51 can optimize the timing of performing the fuel pressure change indication and the fuel injection timing, thereby making makes it possible to suppress the real fuel injection amount from being differentiated from the target fuel injection amount even at the time of the fuel pressure being changed.

Further, the ECU 51 can calculate the time required to change the state of the changeover valve 60 even after the fuel pressure change indication is performed to the changeover valve 60.

Further, the ECU 51 can calculate the time required to change the state of the changeover valve 60 even when the change of the fuel pressure is generated, thereby estimating the fuel pressure at a certain time. The ECU 51 can execute the fuel injection in accordance with the estimated fuel pressure, thereby making it possible to enhance the degree of accuracy of the fuel injection amount.

The ECU 51 can calculate the switching timing of changing the state of the changeover valve 60 in accordance with the magnitude of the electromotive force Eb of the alternator 35 to be supplied to the changeover valve 60. This makes it unnecessary to directly detect the fuel pressure of the fuel to be supplied to the injector 3, thereby making it unnecessary to provide a sensor for detecting the fuel pressure. Therefore, the fuel supply apparatus can enhance the degree of accuracy of the fuel pressure change control even if the fuel supply apparatus can be produced at a low cost.

The above explanation has been directed to the case in which the ECU 51 is operative to calculate the switching delay time t1 in accordance with the electric current detected at the time td immediately after the transistor 69 is changed from the "OFF" state to the "ON" state. The ECU 51 may be operative to always acquire the electric current "I" to be detected by the wire monitor 59, and to set as the time T1 the time when the magnitude of the electric current "I" reaches a magnitude necessary for the valve 67 to start to move according to the present invention.

Further, the above explanation has been directed to the example in which the ECU 51 is operative to preliminarily memorize the switching delay time map in the ROM 54. The ECU 51, however, may be operative to have the ROM 54 memorize an equation for calculating the time T1 from the value of the electric current at the time Td, and to calculate the time T1 in accordance with the equation memorized in the ROM 54 when the value of the electric current is detected in Step S33 according to the present invention.

Further, the above explanation has been directed to the case in which the ECU 51 is operative to have the fuel pressure changed from the low pressure side to the high pressure side. The ECU 51, however, may be operative to calculate the switching delay time t1 in accordance with the electric current "I", and to refer the calculation to the injection timing of the fuel injection control even when the fuel pressure is changed from the high pressure side to the low pressure side similarly to the second embodiment according to the present invention.

In this case, similarly to the second embodiment, the ECU 51 is operative to preliminarily memorize in the ROM 54 the valve movement time interval from the starting time of the movement of the valve 67 to the time of the valve 67 reaching the low dead point, the fuel pressure change time interval from the fuel pressure at the high pressure side to the fuel pressure at the low pressure side after the valve reaches the low dead point, and the fuel pressure fluctuation time interval from the fuel pressure at the low pressure side changed to the steady pressure state according to the present invention.

Further, the ECU 51 is operative to calculate the switching delay time t1 from the time T0 when the change request for the fuel pressure is generated to have the transistor 69 changed from the "ON" state to the "OFF" state to the time T1 when the valve 67 starts to move in accordance with the magnitude of the electric current "I" at the time Td. At this time, the ECU 51 is operative to calculate the time until the fuel pressure is changed to the low pressure side and reaches to the steady fuel pressure with reference to the valve movement time, the fuel pressure change time and the fuel pressure fluctuation time.

The ECU 51 is then operative to carry out the cooperative control for cooperatively executing the fuel pressure change control and the fuel injection control to have the timing of injecting the fuel by the fuel injection control delayed from the time when the fuel pressure comes to be low.

From the foregoing description, it will be appreciated that the fuel supply apparatus according to the present invention can be operated to optimize the timing of performing the fuel pressure change indication and the fuel injection timing, thereby making it possible to suppress the real fuel injection amount from being differentiated from the preferred fuel injection amount even at the time of the fuel pressure being changed. This means that the fuel supply apparatus according to the present invention can accomplish an advantageous effect to improve the fuel consumption, and is useful in supplying the fuel while adjusting the pressure of the fuel stored in the fuel tank.

REFERENCE SIGNS LIST

1: engine
2: fuel tank
3: injector
3*a*: end portion
4: delivery pipe
5: cylinder
6: ignition plug
8: fuel supply apparatus
10: fuel pressure supply mechanism
11: fuel pump unit
11*p*: fuel pump
15: fuel pressure
15*a*: branch passage
20: pressure regulator
21*a*: fluid introduction opening
21*b*: fluid discharge opening
22: pressure adjustment member
25: movable valve body portion
34: electric power supply unit
35: alternator
45: cooling water temperature sensor
47: fuel temperature sensor
51: ECU
59: wire monitor
60: changeover valve
61: electromagnet coil
63: bobbin
64: seal portion
65: shield member
67: valve
69: transistor
70: opening end portion
75: fuel pipe portion

The invention claimed is:

1. A fuel supply apparatus for supplying fuel to a fuel consumption unit after adjusting the pressure of the fuel, comprising:

a variable fuel pressure adjustment valve capable of assuming at least one of a high pressure state in which the fuel is maintained at a high pressure, and a low pressure state in which the fuel is maintained at a low pressure, a changeover valve for changing the variable fuel pressure adjustment valve between the high pressure state and the low pressure state in response to an electric property of an electric power inputted therein, and a switching control unit for controlling the electric power to be inputted or not inputted into the changeover valve, the switching control unit being operative to set the switching timing of switching the changeover valve selectively in the high pressure state or in the low pressure state in accordance with the electric property of the electric power inputted into the changeover valve.

2. The fuel supply apparatus as set forth in claim 1, in which the switching control unit is set to make early the switching timing of the changeover valve when the electric property has a value to allow the changeover valve to start switching late to the changeover valve as compared with when the electric property has a value to allow the changeover valve to start switching early to the changeover valve.

3. The fuel supply apparatus as set forth in claim 1, in which the electric property has a value indicative of the magnitude of an electromotive force of an alternator operative to generate the electric power with the drive force outputted from an internal combustion engine.

4. The fuel supply apparatus as set forth in claim 1, in which the switching control unit is operative to have the electromotive force of the alternator as the electric property before the state of the changeover valve is changed.

5. A fuel supply apparatus for supplying fuel to a fuel consumption unit after adjusting the pressure of the fuel, comprising:

a variable fuel pressure adjustment valve capable of assuming at least one of a high pressure state in which the fuel is maintained at a high pressure, and at a low pressure state in which the fuel is maintained at a low pressure, a changeover valve for changing the variable fuel pressure adjustment valve between the high pressure state and the low pressure state in response to an electric property of an electric power to be inputted therein, and a switching control unit for controlling the electric power to be inputted or not inputted into the changeover valve, the switching control unit being operative to detect the electric property of the electric power to be inputted or not inputted into the changeover valve under the condition that the supply or the non-supply of the electric power to the changeover valve is changed, and to estimate the time required to change the fuel pressure in accordance with the detected electric property.

6. The fuel supply apparatus as set forth in claim 5, in which the switching control unit is operative to estimate the time required to change the fuel pressure after the supply or the non-supply of the electric power to the changeover valve is changed and before the state of the changeover valve starts to be changed.

7. The fuel supply apparatus as set forth in claim 5, in which the switching control unit is operative to have an electric current value inputted into the changeover valve as the electric property.

8. The fuel supply apparatus as set forth in claim 5, which further comprises a fuel injection control unit for controlling the timing of injecting the fuel in the fuel consumption unit, the fuel injection control unit being operative to adjust the timing of injecting the fuel based on the time required to change the fuel pressure calculated by the switching control unit.

9. The fuel supply apparatus as set forth in claim 5, which further comprises a wire breaking detection unit for detecting whether or not there is generated the breaking of an electric wire to supply the electric current to the changeover valve based on the magnitude of the electric current flowing in the electric wire, the switching control unit being operative to calculate the time required to change the fuel pressure based on the magnitude of the electric current detected by the wire breaking detection unit.

10. The fuel supply apparatus as set forth in claim 1, in which the variable fuel pressure adjustment valve comprises a housing having a fuel introduction opening through which the fuel is introduced into the housing and a fuel discharge opening through which the fuel is discharged to the outside, and a pressure adjustment member having a partition wall portion forming together with the housing a pressure adjustment chamber held in communication with the fuel introduction opening, and a movable valve portion displaceable in response to the fuel pressure in the pressure adjustment chamber in a direction to take its opening state in which the pressure adjustment chamber is brought into communication with the fuel discharge opening, the housing accommodating therein a first valve seat portion and a second valve portion, the first valve seat portion forming in the inside of the pressure adjustment chamber a discharge passage to be held in communication with the fuel discharge opening and variable in opening degree in response to the movable valve portion, and the second valve portion forming in the inside of the pressure adjustment chamber an operation pressure fuel introduction passage to be variable in opening degree in response to the movable valve portion and to allow the fuel having an operation pressure to be introduced therein, the pressure adjustment member having an area to receive the fuel pressure in the direction to take its opening state, the area being variable in response to the operation pressure in the operation pressure fuel introduction passage.

11. The fuel supply apparatus as set forth in claim 5, in which the variable fuel pressure adjustment valve comprises a housing having a fuel introduction opening through which the fuel is introduced into the housing and a fuel discharge opening through which the fuel is discharged to the outside, and a pressure adjustment member having a partition wall portion forming together with the housing a pressure adjustment chamber held in communication with the fuel introduction opening, and a movable valve portion displaceable in response to the fuel pressure in the pressure adjustment chamber in a direction to take its opening state in which the pressure adjustment chamber is brought into communication with the fuel discharge opening, the housing accommodating therein a first valve seat portion and a second valve portion, the first valve seat portion forming in the inside of the pressure adjustment chamber a discharge passage to be held in communication with the fuel discharge opening and variable in opening degree in response to the movable valve portion, and the second valve portion forming in the inside of the pressure adjustment chamber an operation pressure fuel introduction passage to be variable in opening degree in response to the movable valve portion and to allow the fuel having an operation pressure to be introduced therein, the pressure adjustment member having an area to receive the fuel pressure in the direction to take its opening state, the area being variable in response to the operation pressure in the operation pressure fuel introduction passage.

* * * * *